US012291934B2

(12) United States Patent
Godøy et al.

(10) Patent No.: US 12,291,934 B2
(45) Date of Patent: May 6, 2025

(54) ACTIVELY CONTROLLED BAILER

(71) Applicant: Equinor Energy AS, Stavanger (NO)

(72) Inventors: Rune Godøy, Sandnes (NO); Bård Marius Johansen, Ranheim (NO); Morten Eidem, Trondheim (NO); Gjermund Grimsbo, Trondheim (NO)

(73) Assignee: EQUINOR ENERGY AS, Stavanger (NO)

( * ) Notice: Subject to any disclaimer, the term of this patent is extended or adjusted under 35 U.S.C. 154(b) by 225 days.

(21) Appl. No.: 17/780,921

(22) PCT Filed: Nov. 27, 2020

(86) PCT No.: PCT/NO2020/050293

§ 371 (c)(1),
(2) Date: May 27, 2022

(87) PCT Pub. No.: WO2021/107785

PCT Pub. Date: Jun. 3, 2021

(65) Prior Publication Data

US 2022/0412178 A1 Dec. 29, 2022

(30) Foreign Application Priority Data

Nov. 29, 2019 (GB) ..... 1917501
Jan. 28, 2020 (GB) ..... 2001171

(51) Int. Cl.
*E21B 27/02* (2006.01)
*E21B 33/13* (2006.01)

(52) U.S. Cl.
CPC ..... *E21B 27/02* (2013.01); *E21B 33/13* (2013.01); *E21B 2200/05* (2020.05)

(58) Field of Classification Search
CPC ..... E21B 27/02; E21B 33/12; E21B 33/13; E21B 33/134; E21B 33/1275;
(Continued)

(56) References Cited

U.S. PATENT DOCUMENTS 2,064,336 A * 12/1936 Bates ..... E21B 27/02 166/165
2,453,068 A 11/1948 Haynes
(Continued)

FOREIGN PATENT DOCUMENTS

EP 2 192 262 A1 6/2010
WO WO 00/66878 A1 11/2000
(Continued)

OTHER PUBLICATIONS

Combined Search and Examination Report under Sections 17 and 18(3) issued in Application No. GB1917501.7 dated Apr. 16, 2020.
(Continued)

*Primary Examiner* — George S Gray
(74) *Attorney, Agent, or Firm* — Birch, Stewart, Kolasch & Birch, LLP

(57) ABSTRACT

A container device for transporting and releasing a plugging material into a well includes a longitudinal chamber for containing the plugging material, the chamber including a tubular wall extending in a longitudinal direction and at least one opening for releasing the plugging material from the chamber; a lower seal extending across the opening and closing the chamber in a closed configuration; a pressure application mechanism provided at an upper portion of the container device for pressurising at least part of the device and expelling the plugging material; and a connector provided at an upper portion of the container device for attaching the container device to an elongate member for lowering into a wellbore.

16 Claims, 19 Drawing Sheets

(58) Field of Classification Search
CPC ..... E21B 34/063; E21B 34/06; E21B 23/01; E21B 2200/04; E21B 2200/05
See application file for complete search history.

(56) References Cited

U.S. PATENT DOCUMENTS

| | | | | |
|---|---|---|---|---|
| 2,618,345 | A * | 11/1952 | Tucker | E21B 33/134 166/123 |
| 6,595,281 | B1 * | 7/2003 | Beach | E21B 23/08 166/334.4 |
| 2003/0150614 | A1 * | 8/2003 | Brown | E21B 41/0042 166/117.6 |
| 2010/0122814 | A1 | 5/2010 | Picou | |
| 2014/0318782 | A1 * | 10/2014 | Bourque | E21B 27/02 166/177.4 |
| 2015/0240583 | A1 * | 8/2015 | Mineo | E21B 27/04 166/104 |
| 2015/0292288 | A1 * | 10/2015 | Kasperski | E21B 27/02 166/65.1 |
| 2017/0306714 | A1 * | 10/2017 | Haugland | E21B 33/1275 |
| 2019/0178051 | A1 * | 6/2019 | Beach | C09K 8/04 |

FOREIGN PATENT DOCUMENTS

| | | | |
|---|---|---|---|
| WO | WO 2014/051588 | A1 | 4/2014 |
| WO | WO 2014/084807 | A1 | 6/2014 |
| WO | WO 2016/053113 | A1 | 4/2016 |
| WO | WO 2018/023162 | A1 | 2/2018 |

OTHER PUBLICATIONS

Combined Search and Examination Report under Sections 17 and 18(3) issued in Application No. GB2001171.4 dated Apr. 16, 2020.
International Search Report for PCT/NO2020/050293 (PCT/ISA/210) mailed on May 11, 2021.
PCT/ISA/206 issued in PCT/NO2020/050293 mailed on Mar. 19, 2021.
Written Opinion of the International Searching Authority for PCT/NO2020/050293 (PCT/ISA/237) mailed on May 11, 2021.

* cited by examiner

ACTIVELY CONTROLLED BAILER

FIELD OF THE INVENTION

The invention relates to wireline tools for use in a wellbore, and more specifically to wireline tools for transporting sealant or plugging material into a wellbore.

BACKGROUND

A hydrocarbon producing well has a limited life span. When the well becomes depleted due to the removal of hydrocarbons there will be a moment it will not be economical to continue operation of the well. The wellbore then needs to be abandoned in a safe way to mitigate the chance of remaining hydrocarbons leaking into the environment. A well may be abandoned permanently or temporarily. When abandoning a wellbore a plug needs to be placed to avoid leaks. The process is referred to as plug and abandonment, or P&A. A typical well includes a liner or casing which forms a barrier between the surrounding formation and the well. Methods for abandoning wells involve placing a plug across the entire cross section of the well. Any cables or tubulars inside the well are usually removed in the area of the plug such that there are no obstructions and the plug can extend continuously from one formation wall to the opposite formation wall. Alternatively, tubulars are left in place and a plug is placed across one or more annuli and tubulars provided within the well. The plug prevents hydrocarbons from leaking out of the well after abandonment. A typical plug is formed of cement or other sealant material, which may be pumped into the wellbore from the surface. When openings are created within a casing or tubular, then the cement or other sealant can travel through those openings into an annulus and back up to the surface. Once the cement is set both in the wellbore and the annulus, a plug is provided against the formation and the plug can be tested for integrity.

STATEMENT OF INVENTION

According to a first aspect of the invention, there is provided a container device for transporting and releasing a plugging material into a well, the container device comprising: a longitudinal chamber for containing the plugging material, the chamber comprising a tubular wall extending in a longitudinal direction and at least one opening for releasing the plugging material from the chamber; a lower seal extending across the opening and closing the chamber in a closed configuration; a pressure application mechanism provided at an upper portion of the container device for pressurising at least part of the device and expelling the plugging material; and a connector provided at an upper portion of the container device for attaching the container device to an elongate member for lowering into a wellbore.

The lower seal may comprise a plug which extends across the inner cross section of the tubular wall of the longitudinal chamber perpendicular to the longitudinal direction of the chamber, and the lower seal may have a mobile sealing connection such that the lower seal can travel along the inner diameter of the tubular wall while maintaining a sealing connection to the tubular wall. The lower seal may be received within a landing profile provided at a lower end of the container. The lower seal may comprise a pressure sensitive activation mechanism such as a burst mechanism, or alternatively the lower seal may be burst by landing on a lancet provided on a plug set within the well.

The container device may further comprise an upper seal, and the upper seal, lower seal and part of the tubular wall of the longitudinal chamber may be arranged to enclose the sealing material in use. The upper seal may comprise a plug which extends across the inner cross section of the tubular wall of the longitudinal chamber perpendicular to the longitudinal direction of the chamber, and wherein the upper seal has a mobile sealing connection such that the upper seal can travel along the tubular wall in longitudinal direction while maintaining a sealing connection to the tubular wall.

The pressure application mechanism may comprise a pump provided above the upper seal and the upper seal may be arranged to move away from the pump when the pressure above the upper seal increases above a threshold value.

Alternatively, the pressure application mechanism may comprise said upper seal, and further comprises a connection to the lower seal. The lower seal may be connected to a plug which can be set against the casing or tubular outside the container device. The connection may have a predetermined maximum extension such that the upper seal has a fixed distance to the plug and travels down the container device when the container device moves to the surface while the plug is set against the casing or tubular. A pressure equaliser can be provided in an upper part of the chamber above the upper seal.

The connection may further comprise a cable providing an electrical, mechanical or hydraulic connection to the bridge plug for activating the plug. The device may further comprise a pump and a hydraulic chamber provided in the plug for setting the plug.

A check valve may be provided below the lower seal for preventing inflow of fluids from outside the container device. Additionally, or alternatively, one or more flapper valves may be provided below the lower seal for preventing inflow of fluids from outside the container device.

A latch may be provided at a lower part of the container device for latching onto a landing structure. Packers or slips may be provided outside the chamber for connecting to an external tubular or casing.

The container device may comprise a hose. In an example, the hose may be provided within another tubular, defining an annulus between.

According to a second aspect of the invention, there is provided an assembly comprising a container device according to the first aspect, and further comprising a landing packer for receiving the container device. The landing packer may comprise a check valve and a sealing mechanism for sealing the landing packer against a casing or tubular. The latch may be arranged to engage with the landing packer.

The elongate member for lowering the container device into a wellbore may be part of the assembly, the elongate member being one of: a wireline, coiled tubing and a drill pipe. The elongate member may further comprise a cable for providing communication and/or power to the container device. In an example, the elongate member may be configured to rotate around the longitudinal axis of the elongate member to induce circumferential flow in the plugging material within the container device.

The assembly may further comprise a wireline tractor provided beneath the lower seal.

The assembly may further comprise a first vibration assembly, comprising one or more vibration elements, and wherein these vibration elements are mechanically coupled to the container device. These vibration elements may be configured to generate an oscillating radial displacement of the plugging material within the container device. In an example, each vibration element may comprise an annulus circumferentially around the container device. In some examples, the vibration elements may be provided within the annulus defined between the hose and the tubular. The frequency and power of the vibration elements and rotation of the elongate member is configured to induce flow within the plugging material to remove entrapped air.

The assembly may further comprise a second vibration assembly, comprising one or more vibration elements. In some examples, the second vibration assembly and the first vibration assembly are the same. The vibration assembly is mechanically coupled to the tubular in which the container device is provided. In some examples, the second vibration assembly may be provided longitudinally proximal to a circumferential opening generated in the tubular, and wherein said vibration assembly abuts against the casing of the tubular. Each vibration element may comprise an annulus, wherein the annulus abuts the inside circumferential edge of the tubular. In some examples, the second vibration assembly may be deployed using an extendable member integrated on the container device, wherein the extendable member is configured to deploy the vibration elements to the tubular.

According to a third aspect, there is provided a method of plugging a well, the method comprising: lowering a container device into a wellbore; opening a lower seal in the container device; increasing pressure in a container of the container device containing plugging material; and expelling the plugging material from the container.

The method may further comprise setting the container device within the wellbore and expelling the plugging material into the annulus to a level higher than the lowest part of the container. The method may further comprise, prior to said lowering, hanging the container device off a support structure at the surface and filling the container device with the plugging material.

The method may further comprise assembling the container by connecting multiple sections of container, lowering the container partially into the wellbore and repeating said hanging and filling. The method may further comprise bursting a lower seal provided within the container.

FIGURES

Some embodiments of the invention will now be described by way of example only and with reference to the accompanying drawings, in which.

DETAILED DESCRIPTION

Figure 1D:
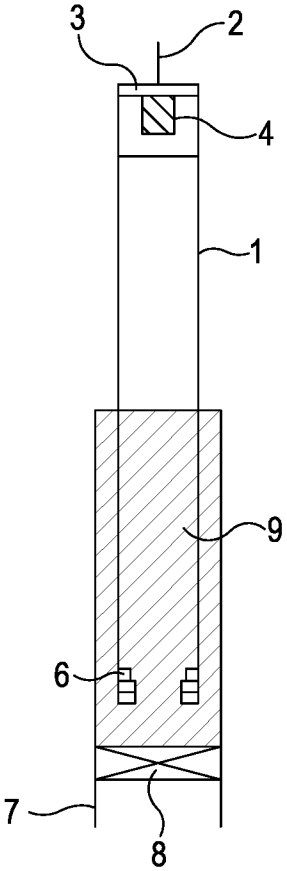
FIG. 1 illustrates four stages of use of a container device shown schematically in a vertical cross section.
Figure 1C:
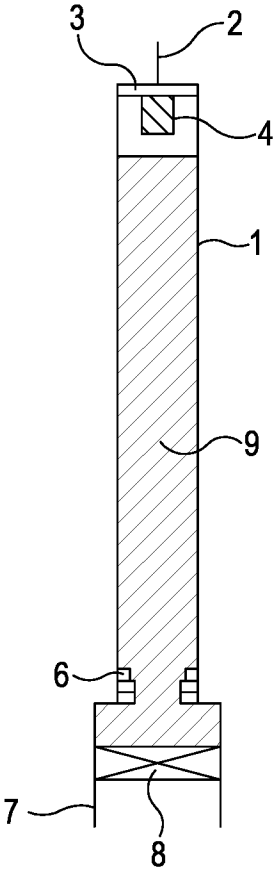

Plugging operations are typically performed with drilling rigs, and the operations are both time consuming and costly. It is proposed that a wireline conveyed tool for spotting very large volumes (2001 or more) of sealant (e.g, cement) would provide many benefits over conventional processes. In such a deployment, there is no need for retrieval of tubing and/or casing, and so, the plugging operation can be performed with less equipment and fewer personnel, potentially operating as a standalone/offline/rigless operation.

The device disclosed herein provides a way of actively controlling the release of plugging material from a wireline bailer. The bailer is a wireline device, so a connector is provided at a top end of the device to be able to connect it to the wireline. The device does not need to be attached to a wireline but can also be attached to coiled tubing or a drill-pipe whereby a cable runs through (or outside) the tubing or drill-pipe for power supply and/or communication to the device. The release of the plugging material is controlled using pressure. The control can be carried out remotely from the surface using the wireline or other cable connection to the bailer. The pressure control enables a more accurate release of plugging material when compared to a system with a mechanical mechanism such as a valve which is simply opened without further control of the release after opening. The pressure control also enables the plugging material to be injected into the annulus upwards from the place of injection because an overpressure can be created with respect to the pressure of the surrounding fluids. Another possible application of the device can be the plugging of leaks in a plug which has already been created within the annulus. The pressure control can be used to squeeze a plugging material into the leak path to seal off the leak path.

The device comprises a generally longitudinal chamber which can contain the plugging material such as cement. The chamber has an opening at a lower end for releasing the plugging material and the opening is closed by a seal until release is required.

The primary example of a plugging material discussed herein is cement, but there are many other materials which can be used as plugging materials. Other examples are: grouts such as barite, calcium carbonate, clay mixtures, or other inert particular mixtures. Thermosetting, or thermoplastic polymers and composites such as resins, epoxy, polyester, polyethylene, polyamide, etc (a heat source may also need to be provided in some of these examples); elastomeric polymers such as rubber, neoprene, silicone rubber, etc; metals including alloys such as bismuth-based materials. The skilled person will be aware of the strict requirements which a plug, and therefore the plug material, needs to satisfy. Materials used in the pressure-controlled device discussed herein will need to be liquid when transported in the container and pushed out of the container.

The pressure control mechanism can be implemented in different ways. A first example is a pressure pump provided at an upper end of the chamber. The pump can apply hydraulic pressure or gas pressure onto a liquid or gas provided above the plugging material. When pressure is increased, plugging material is expelled at a rate depending on the amount of pressure. The pressure can also be lowered to reduce or even stop release of plugging material. The pressure can be applied onto a liquid or gas provided within the chamber directly above the plugging material, provided the liquid or gas has a lower density than the plugging material because otherwise the liquid or gas would be expelled instead of the plugging material. Alternatively, the liquid or gas is separated from the plugging material by an upper seal such as a bung which can move through the chamber like a piston. An increased pressure above the piston will move the piston down and expel the plugging material. A source of gas such as a canister can be provided within the container, but in another example fluid from outside the container is pumped into the container by the pump.

A second example of a pressure control mechanism is an upper seal such as a bung or piston connected to an anchoring point outside the wireline device. The connection keeps the piston at a fixed position with respect to the anchoring point when the wireline device is lifted up, so the piston is therefore pulled down with respect to the wireline device and the plugging material is expelled.

The lower seal needs to open for the plugging material to be able to be expelled from the container. The lower seal may include a burst mechanism, which opens when a predetermined threshold pressure within the container above the lower seal is exceeded. The lower seal can also be moved over a threshold provided within the wall of the container without bursting. Alternatively, an external structure can be provided which pierces the lower seal. The external structure can be a penetrating mechanism such as a spike or other sharp object pointing up towards the lower seal. The external structure can be placed on a packer or bridge plug which is set within the wellbore. The lower seal may also be attached to a bridge plug which is set within the wellbore, such that when the container is raised, the lower seal is pulled out of the container.

A pressure release mechanism is provided at an upper part of the device. The pressure required to expel the plugging material needs to be higher than the surrounding well pressure and may be high enough to pose a safety risk when the device is recovered to the surface after use. The pressure release mechanism can be activated to equalise the pressure to atmospheric pressure at the surface.

At a lower end of the device, one or more one-way valves can be provided to prevent inflow of well fluids into the device.

The device is able to provide an overpressure with respect to the surrounding well in order to expel the plugging material. When the plugging material is expelled, the plugging material will move through the well along the path of least resistance, which includes the area around the device and upwards in the absence of other structures. The path of the plugging material can be controlled by setting additional structural components outside the device. In a first example, a seal such as an inflatable packer is provided within the space outside the container and around the container. This seal will close the space between the device and the surrounding tubular or casing. The seal will prevent the plugging material from moving upwards beyond the seal, but the plugging material can move downwards. In an alternative or additional example, a one-way valve is set within the wellbore below the device and the device directly engages with that one-way valve such that the plugging material only moves past the one-way valve in one direction.

In a further example, a packer is set within the wellbore below the device blocking downwards migration of plugging material and a seal is provided at the device to prevent upwards migration of plugging material. Openings are provided within the casing or tubular between the two seals and the plugging material will be expelled into the annulus when the device is activated. If a further seal is provided within the annulus below the openings, the plugging material will move upwards within the annulus. An advantage of that arrangement is that plugging material can be set within the annulus without plugging material being set within the wellbore at the same depth such that the plugging material within the annulus can be tested for integrity before the remaining space within the wellbore is also filled up with plugging material using the same device again.

The device may be built up of one or more different sections which are connected together to form the longitudinal chamber. One example of a method of assembling the device comprises: inserting a first tubular section into a well, attaching a second tubular section to the first tubular section while the top of the first section still emerges above the surface, then lowering the combined sections further down the well and attaching a third section to the second section, and so on. After a container has thus been assembled with a length to contain a required amount of plugging material, the lower seal can be inserted from the top and pushed down by filling up the chamber with plugging material. An advantage of first assembling and then driving down the lower seal by filling up with plugging material is that large buoyancy forces are avoided. The buoyancy is reduced because initially the chamber is effectively an open pipe which can fill with well fluids, rather than an empty container which displaces a large amount of well fluids.

The device may also be configured differently for the purpose of collecting well fluids inside the well and retrieving the collected fluids to the surface for further analysis. This step may be carried out before or after the process of releasing plugging material in the well. The device suitable for collecting fluids within a well comprises: a longitudinal chamber for receiving the well fluids, at least one opening for taking in fluids into the chamber; a one-way valve arranged within the opening; a pressure control mechanism for lowering the pressure within the chamber to a pressure below the pressure outside the chamber such that fluids are drawn into the chamber; and a connector provided at an upper portion of the container device for attaching the container device to an elongate member for lowering into a wellbore. The one-way valve can comprise one or more flapper valves and/or check valves. The device can be re-configured as follows: the same tubular sections as described previously can be used, a pressure pump can be provided within the tubular sections for drawing in fluids as opposed to expelling plugging material, and the one-way valves described above can be placed at a lower part of the tubular sections but with an orientation opposite to that described for expelling plugging material. When using the device for depositing plugging material, the one-way-valves only allow outflow from the container to avoid contamination of the plugging material. When using the device for collecting well fluids, the one-way valves are turned around and only allow inflow of fluid into the container. The check valves, for example a ball valve including a ball which is biased against a seat, can be selected such that the valve opens above a threshold pressure which overcomes the biasing force. After fluids have been collected, the device can be re-assembled for use as a plugging material bailer.

FIG. 1 illustrates four steps in a process of using a wireline container device in a specific embodiment. The device has a container 1 with a longitudinal tubular shape. The container consists of multiple sections which are assembled to form a single container body. A wire 2 (which may also be a coiled tubing or drill pipe) is connected to an attachment 3 at the top of the device. The wire supports the device and also includes communication means such as an electrical cable for enabling communication between the surface and the device, and for activating and controlling the device. A pump 4 is arranged near the top of the device to provide pressure within the container for expelling the plugging material. A lower plug 5 is arranged within the container and can travel up or down the container while maintaining a sealing contact with the inner walls of the container. In FIG. 1A, the lower plug is located at the top of the container before plugging material such as cement is injected into the container. When cement is injected, the lower plug will travel down the container until it is received by landing profile 6 near a lower end of the container. The casing 7 is only illustrated for a small part, but the device will be received completely within the casing in use. The casing 7 extends upwards and downwards from the small section which is illustrated. A bridge plug 8 is set within the casing below the device. When plugging material is released from the device, the bridge plug will prevent the plugging material from dropping further down the well and thereby form a lower end of the plug. Although in FIG. 1A the bridge plug is illustrated as being close to the container, in practice the distance between those two parts will be large when the container is still near the surface before being filled with plugging material.

Figure 1B:
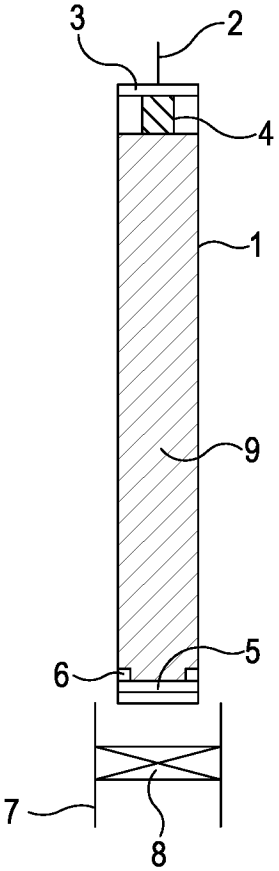
Figure 1A:
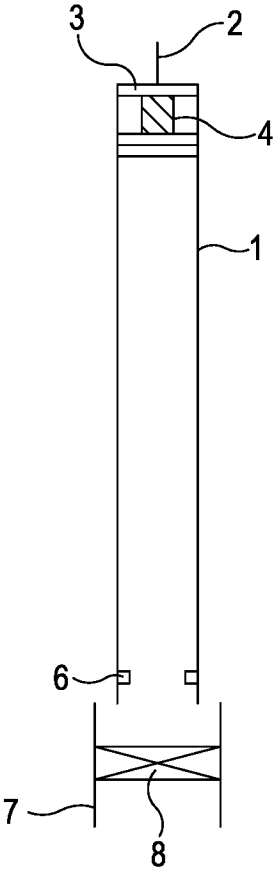

FIG. 1B illustrates the container filled with plugging material 9 and lower plug 5 moved into the landing profile 6 by the weight of the plugging material. The pressure pump 4 does not need to be employed at this stage to drive the lower plug 5 down to the landing profile. The container can be filled with the plugging material by extending a hose or other tubing into an opening (not illustrated) near the top of the device while the top of the device is still located near the surface. Once the container is filled with plugging material, the opening is closed and the device is lowered into the wellbore until it is close to bridge plug 8. The lower plug may be a type of plug called a 'wiper plug' because the sealing contact with the container walls cause the plug to wipe any matter away from the container walls. An advantage of this wiping action is that the plugging material is not contaminated in order to avoid compromising the integrity of the plug by contaminants.

Figure 10:
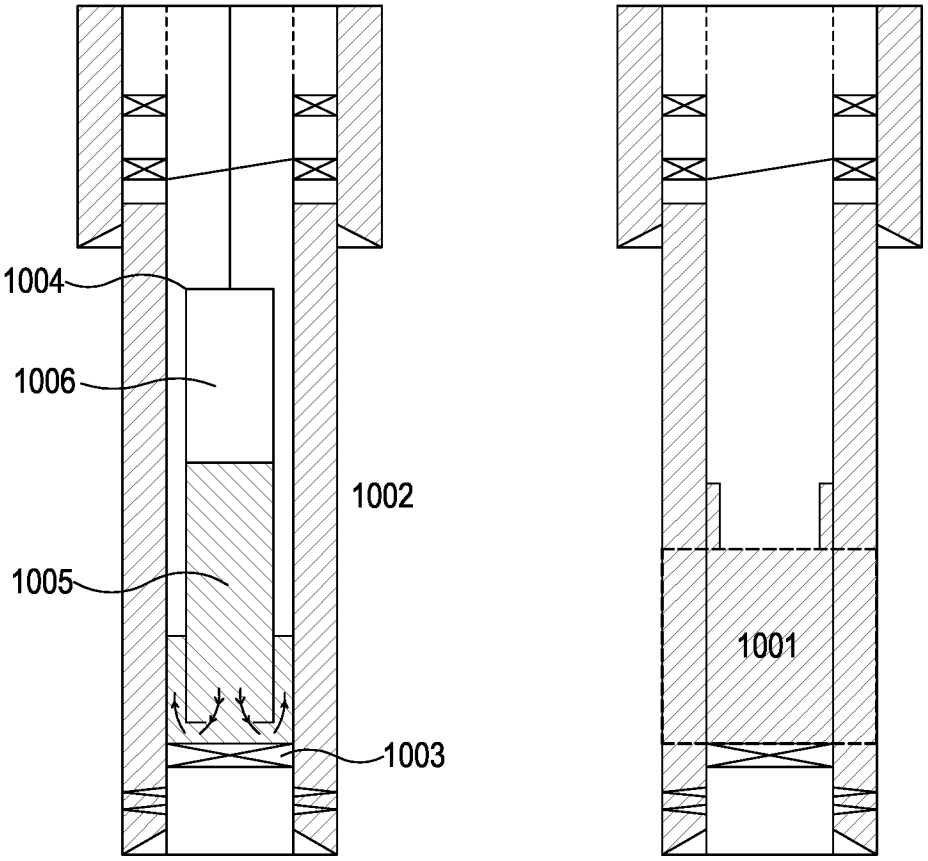
FIG. 10 illustrates a liner plugging procedure.

FIG. 10 illustrates the step where the lower plug 5 has burst due to pressure applied by pressure pump 4 and some of the plugging material 9 has been expelled. A pressure pulse or constant pressure may be used to activate the burst mechanism. The plugging material does not flow below the bridge plug. A pressure pulse can also be used as a signal to the lower plug which opens up after the signal has been detected with a detector at the lower plug.

FIG. 1D illustrates a further step where more of the plugging material 9 has been expelled. The container can be pulled back to the surface using wireline 2 when all plugging material has been expelled, or the container can be raised while the plugging material is being expelled. A pressure regulating valve is provided in a top part of the container (not illustrated) to be able to reduce the high pressure once the empty container is retrieved to the surface in order to avoid dangerous overpressure.

FIG. 2 illustrates a different embodiment. Those parts which are the same as corresponding parts in FIG. 1 have been assigned the same reference numbers and are not discussed again. The difference is the burst mechanism. A sharp object illustrated as lance 21 is used to pierce the lower plug 5 when the device with the plug approaches the bridge plug 8. The lance 21 is arranged on top of the bridge plug and points upwards.

Figure 2D:
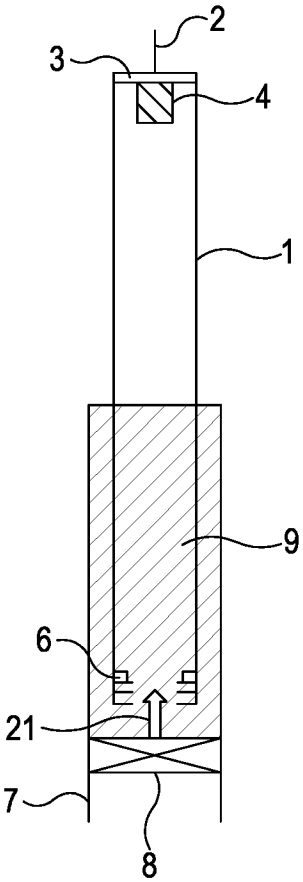
FIG. 2 illustrates four stages of use of a container device shown schematically in a vertical cross section.
Figure 2C:
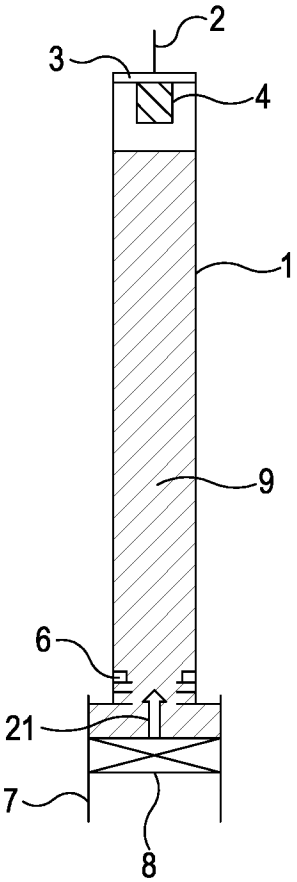
Figure 2B:
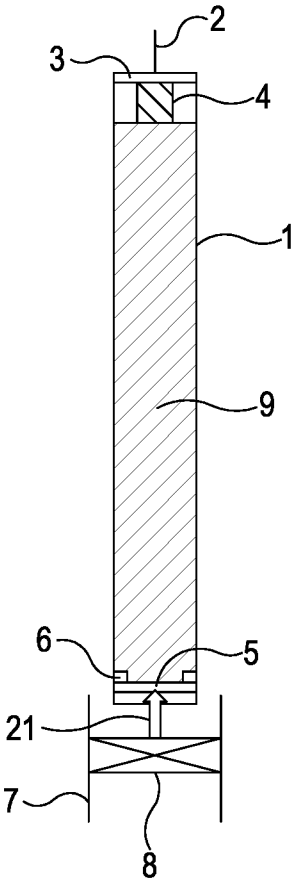
Figure 2A:
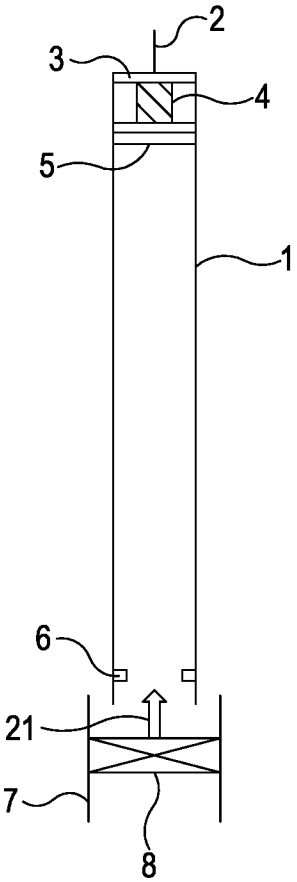
Figure 3D:
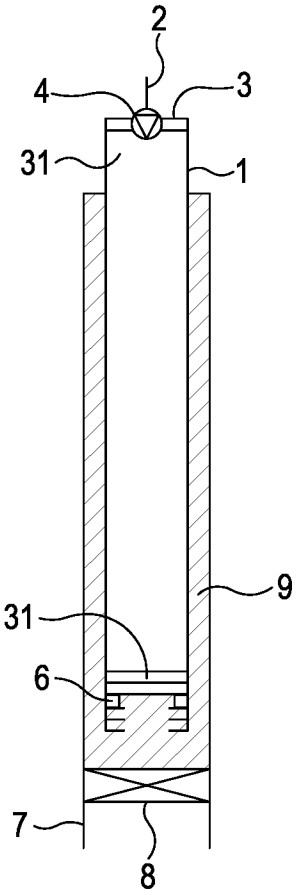
FIG. 3 illustrates four stages of use of a container device shown schematically in a vertical cross section.
Figure 3C:
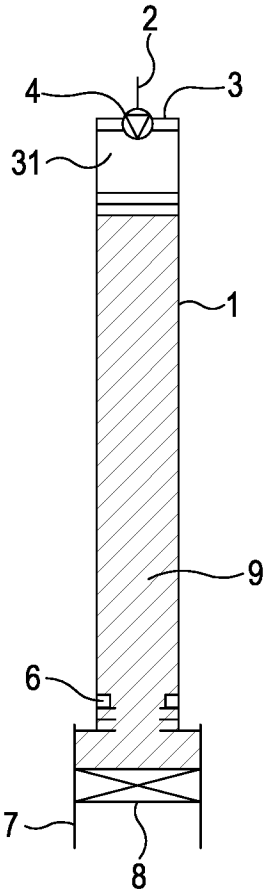
Figure 3B:
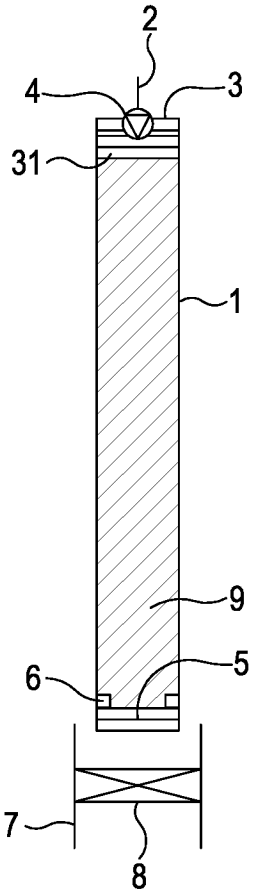
Figure 3A:
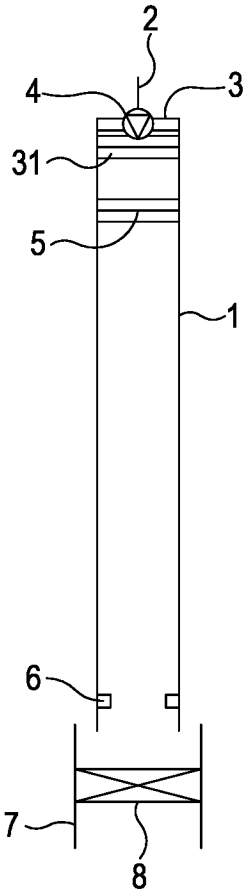
Figure 4D:
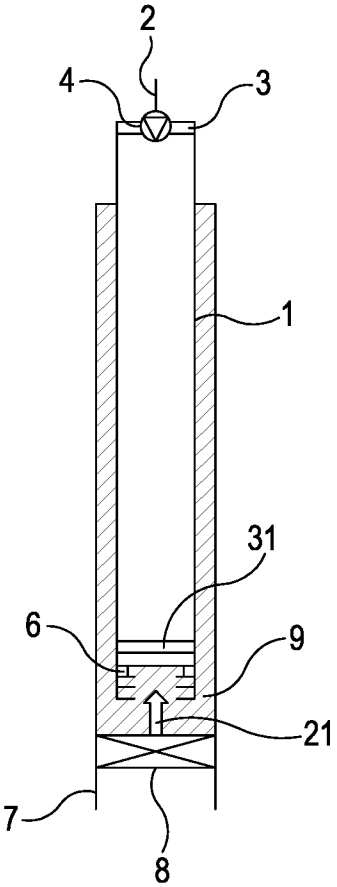
FIG. 4 illustrates four stages of use of a container device shown schematically in a vertical cross section.
Figure 4C:
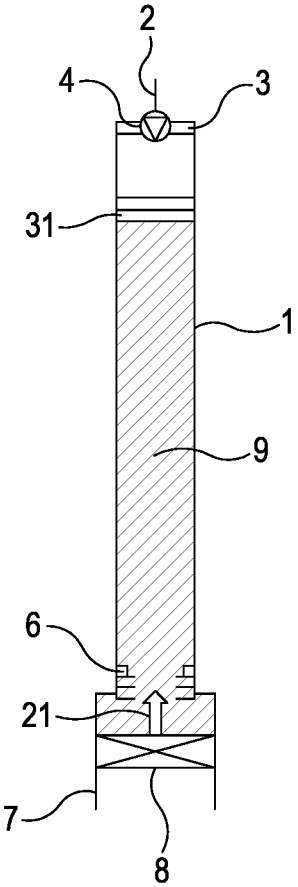
Figure 4B:
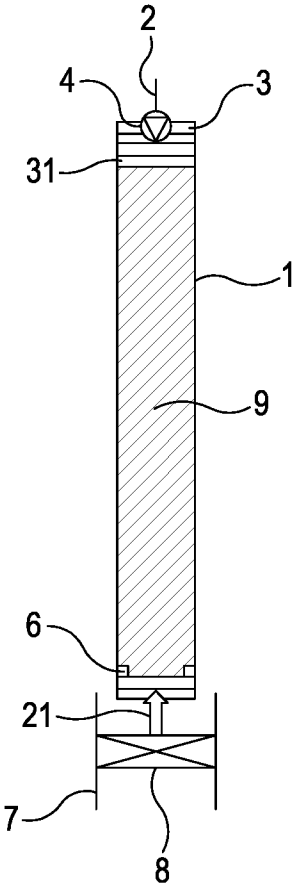
Figure 4A:
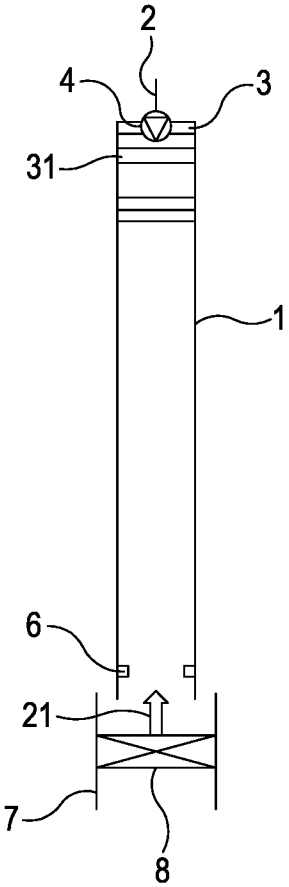
Figure 5E:
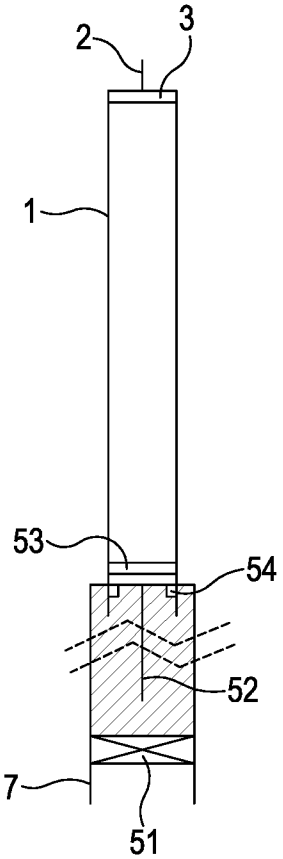
FIG. 5 illustrates four stages of use of a container device shown schematically in a vertical cross section.
Figure 5D:
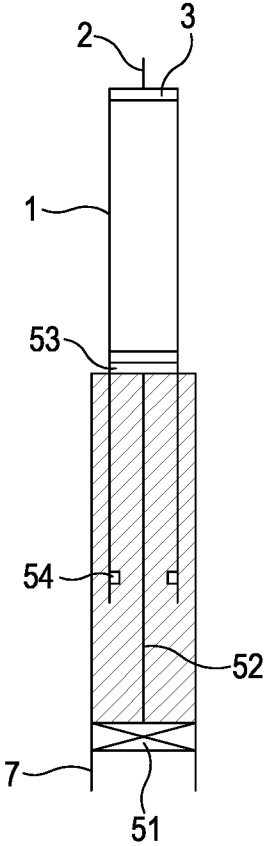
Figure 5C:
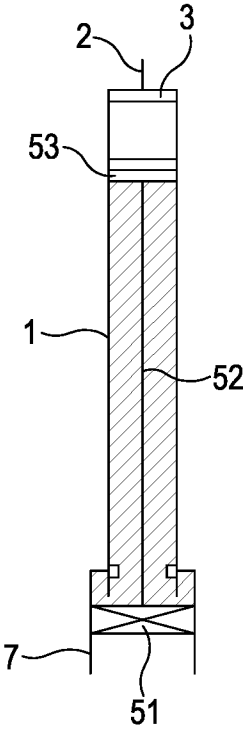
Figure 5B:
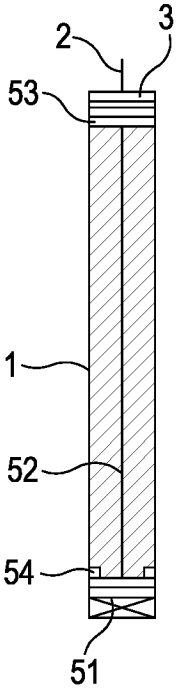
Figure 5A:
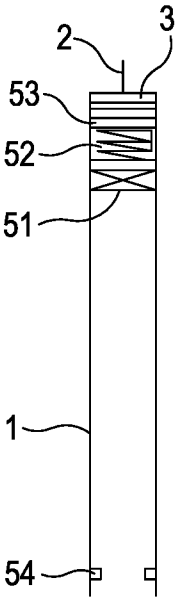

The pump 4 is still used for expelling the plugging material 9, and may also be used to force the lower plug 5 against the lance to aid the piercing process. FIG. 2B illustrates the moment the lance engages with the lower plug and FIG. 2C illustrates the later stage after the lower plug has been pierced.

FIG. 3 illustrates a different embodiment. Those parts which are the same as corresponding parts in FIGS. 1 and 2 have been assigned the same reference numbers and are not discussed again. FIG. 3 includes an upper plug 31 in addition to the lower plug 5. The upper and lower plugs enclose the plugging material. The upper plug is driven down by the pressure applied by pump 4 and FIGS. 3C and 3D illustrate the upper plug expelling the plugging material. An advantage of the upper plug is that re-entry of the plugging material into the container is prevented, but the plug is not a necessary feature as discussed in relation to FIG. 1 which does not include the upper plug.

FIG. 4 illustrates a combination of features of the embodiments illustrated in FIGS. 1 to 3. The upper plug of FIG. 3 is combined with the lance 21 of FIG. 2. The working principles are the same as discussed in relation to the earlier embodiments.

FIG. 5 illustrates a further embodiment including a pressure application mechanism relying on a connection of an upper plug to a fixed anchoring point. The container 1 includes the same wireline connection 3 and wireline 2 as illustrated previously. A lower plug 51 is provided which not only acts as a plug, but also acts as a bridge plug after leaving the container. Landing profile 54 is able to receive the lower plug, while allowing the part of the lower plug which acts as a bridge plug to emerge from the container, as illustrated in FIG. 5B. When the device is lowered to the required position of the casing 7, the plug is inflated to form a sealing plug across the casing 7, as illustrated in FIG. 5C. The sealing plug also forms an anchoring point for a wire 52 which is connected to the upper plug 53. When the container is lifted to the surface, the position of the upper plug is fixed by the maximum extent of the wire 52 and will therefore be kept in place with respect to the bridge plug while moving with respect to the container. The plugging material is expelled by the relative movement of the container and the upper plug. When the upper plug meets the landing profile 54, the upper plug will be retained by the landing profile and the wire snaps, as illustrated in FIG. 5E. Alternatively, the upper plug is allowed to move past the landing profile and drop out of the container. The space above the upper plug 53 can be filled with a gas or with well fluids to replace the plugging material which is expelled.

Figure 6:
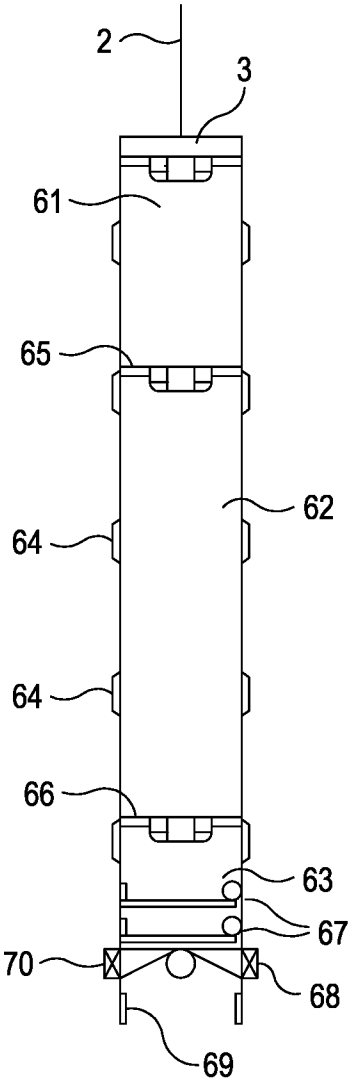
FIG. 6 illustrates a container device schematically in a vertical cross section.

FIG. 6 illustrates the device in further detail, including additional valves at a lower end for preventing inflow of well fluids into the container. Details illustrated in FIG. 6 can be included in the earlier embodiments. A wireline 2 and wireline connector 3 are provided, whereby the wireline connector may include a pressure pump and a pressure equaliser valve and means to fill space 61 between the connector and top plug 65 with a spacing material, for example a gas canister, or a valve to let in well fluids. The top plug 65 can move through the container under pressure like a piston as described before. The top plug acts as wiper plug and has a sealing connection with the inner walls to avoid contamination between the different materials in the device. The main body 62 of the container is filled with plugging material. The container includes multiple sections which are joined together at joints 64, which are also used to hang the device off a base at the surface during assembly. The lower plug 66 also acts as a wiper to avoid contamination between fluids. The space 63 in the device below the lower plug is filled with a spacer fluid, similar to space 61. The space 63 further includes two flapper valves 67, although one or more than two flapper valves may also be used instead. The flapper valves are one-way valves which only allow outflow into the well, but do not allow inflow of fluids from the well into the device. A check valve 68 is further provided below the flapper valves. The check valve is also a one-way valve, but only opens in the outflow direction at a predetermined overpressure. The check valve improves the control over the release of the plugging material. Latches 69 are provided at the lowermost part of the device which can be used to land the device on cooperating features on a landing packer. Side elements 70 protrude sideways and can be slips or inflatable packer elements to engage with the casing and seal the space between the device and the casing. The elements 70, when activated, can be used to block the fluid path around the device back up the wellbore. As discussed in more detail in relation to FIG. 8 below, this can be used to force the sealing material into the annulus.

Figure 7C:
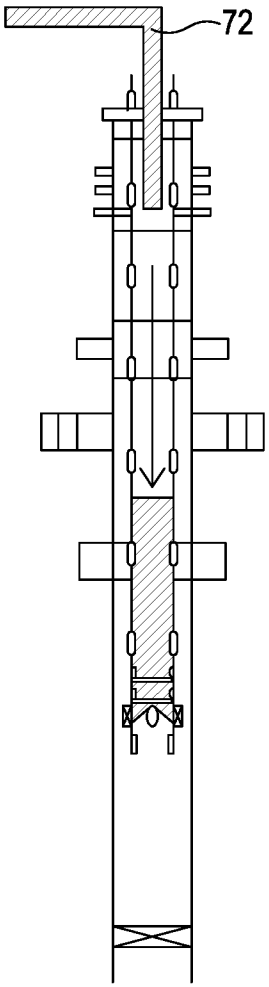
FIG. 7 illustrates different aspects of a container device used within a wellbore.
Figure 7B:
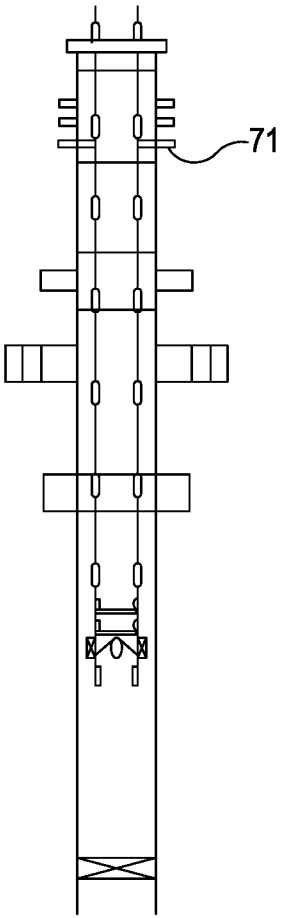
Figure 7A:
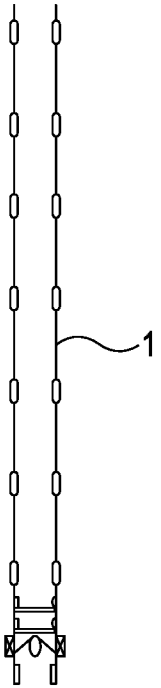

FIG. 7A further illustrates the container 1 comprising a plurality of individual sections joined together to form the required length. The joints are illustrated as thickened portions of the wall. The two flapper valves and the check valve discussed in connection with FIG. 6.

FIG. 7B illustrates the container while extending through the wellhead and attached to the wellhead at connector 71. Above the connector, standard parts of the wellhead are illustrated: a C-plate, a quick test sub (QTS), and a wireline blowout preventer (WL BOP), while below the connector, a shear seal and Christmas tree are illustrated. The relevant valves in these standard parts are opened to allow the container to extend into the well. A mechanical bridge plug is set far below the wellhead and will provide the basis for a plug.

FIG. 7C illustrates the container while being attached to the wellhead and while being filled with a plugging material. A hose 72 is used to fill up the container.

FIG. 8 illustrates a process of setting a plug using the device described above. As described above in connection with FIG. 1, the plugging material can simply be released above a bridge plug to form a permanent barrier. However, the pressure control of the device enables other methods of setting a plug. Illustrated in FIG. 8A is the device 81 as described in connection with FIG. 6, but not all details of the device are illustrated in FIG. 8 for clarity. The device includes a lower check valve 83 with latches extending downwards. A landing packer 82 is set in the wellbore which is able to receive the latches. The landing packer 82 also includes a check valve 84. A lower packer 85 has been set to provide a lower barrier for the plugging material within the wellbore. Openings 86 are formed within the tubular, providing a fluid path into the annulus 87 between the tubular and the casing 88. The annulus 87 is filled with completion fluid in the arrangement illustrated in FIG. 8A.

Figure 8C:
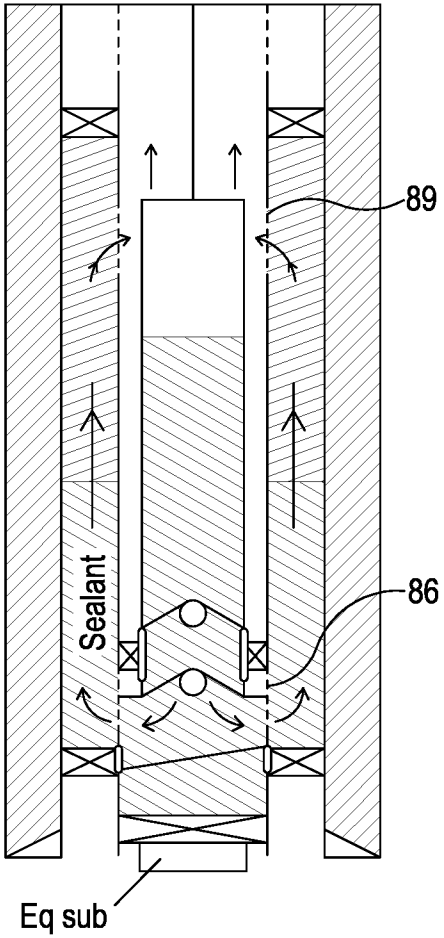
FIG. 8 illustrates 6 stages of use of a container device.
Figure 8B:
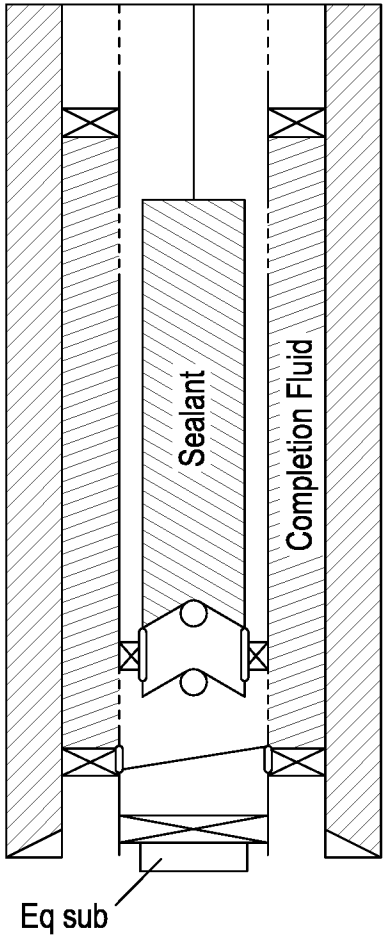
Figure 8A:
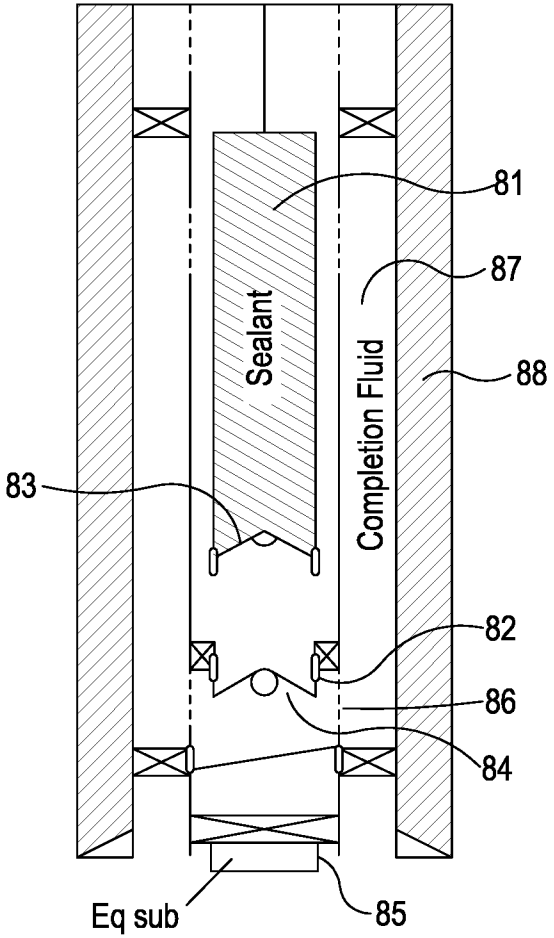

FIG. 8B illustrates the next step of the device being engaged with the landing packer. The check valve on the device and the check valve on the landing packer are now arranged in series, while the latches prevent a fluid path back up the wellbore around the device.

FIG. 8C illustrates the phase of the plugging material being pumped out of the device, and through openings 86 into the annulus. Further openings 89 between the tubular and the wellbore are provided higher up the tubular for releasing the completion fluid into the wellbore when the completion fluid is displaced by the plugging material.

Figure 8D:
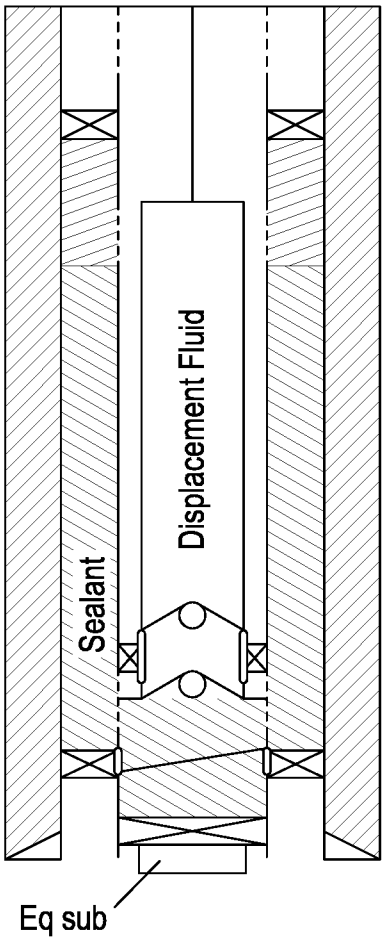

FIG. 8D illustrates the step where all plugging material has been expelled from the device and the device is filled instead with displacement fluid. The plugging material is contained below the landing packer.

Figure 8E:
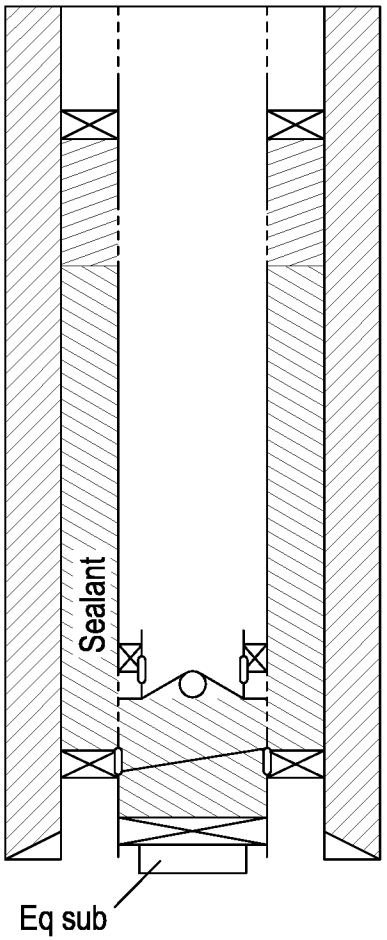

FIG. 8E illustrates the next step where the device has been disengaged from the landing packer and removed from the wellbore. The plugging material may still be fluid before it is fully set, but the check-valve within the landing packer prevents the plugging material from flowing back up the wellbore. As illustrated in FIG. 8E, the plugging material has been pushed up the annulus to a higher level than the check valve. This enables testing of the plugging material within the annulus after it has been set. If integrity of the plugged section of the annulus has been confirmed, the wellbore can further be filled up by dropping more plugging material into the wellbore using the device in the manner illustrated in FIG. 1.

Figure 8F:
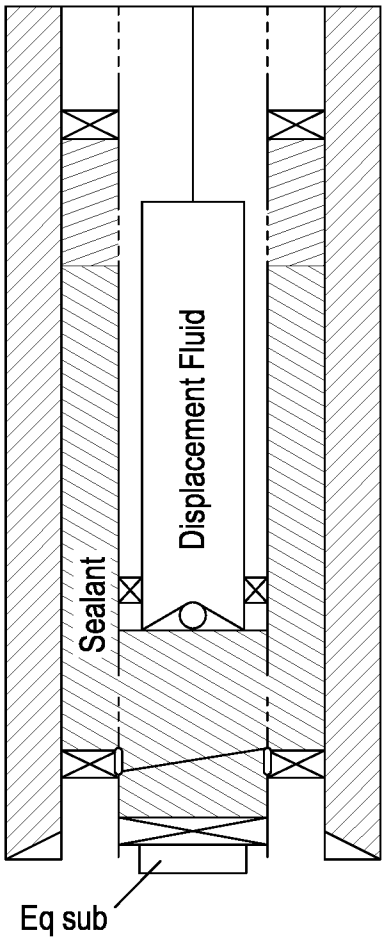

An alternative embodiment is illustrated in FIG. 8F. The landing packer 82 is absent in this embodiment, and instead the device is fixed sealingly against the tubular to prevent flow of plugging material around the tool upwards into the wellbore. The device further needs to stay in place until the plugging material has set to avoid backflow of the plugging material because of the absence of the landing packer.

The device can be used repeatedly. For example, the annulus can be filled with cement in a first step, followed by filling the wellbore in a subsequent step as described in connection with FIG. 8E. The device can also be used for different materials. For example, an initial cleaning step can be carried out by filling the device with cleaning fluids and injecting the cleaning fluids into the plugging area, followed by a step of filling the plugging area with cement using the same tool. In between these steps, the tool is recovered to the surface for re-filling the container.

Figure 9:
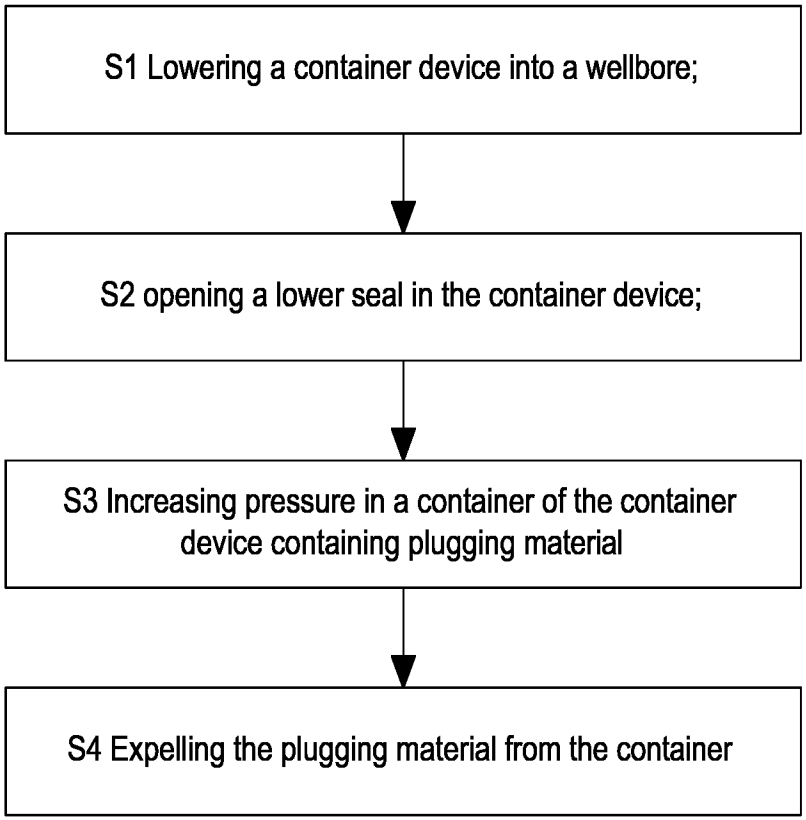
FIG. 9 is a flow diagram.

FIG. 9 is a flow diagram of the method, comprising the steps of: S1 lowering a container device into a wellbore; S2 opening a lower seal in the container device; S3 increasing pressure in a container of the container device containing plugging material; and S4 expelling the plugging material from the container.

The plugging material may be tested to verify the integrity of the plug, as mentioned before. If the plugging material is released and set in multiple stages, the testing is also done at multiple stages. Tagging and 'dressing (off)' are terms of the art relating to specific testing steps. Tagging is a testing method comprising placing a large weight, in some cases as much as 10 tonnes, on top of the plug to ascertain whether the plug can withstand such pressure. Various integrity testing steps can be carried out using a drill string, wireline, or coiled tubing, and associated tools.

The device as previously described is also configured to perform methods for providing a plug within a wellbore in a P&A procedure.

FIG. 10 shows a liner plugging procedure. In this example, a cement plug 1001 is provided within an already cemented tubular 1002, and the mechanical integrity of the cement in the tubular annulus has been verified upfront. In a first step, a fundament for the cement is deployed into the tubular 1003. The fundament is configured to support the cement. The device 1004 is then provided into the tubular. The device is activated to release the sealant or cement 1005 into the liner. In an example, displacement fluid 1006 replaces the space within the device. The cement is left to set, and the barrier plug 1001 is established.

Figure 11A:
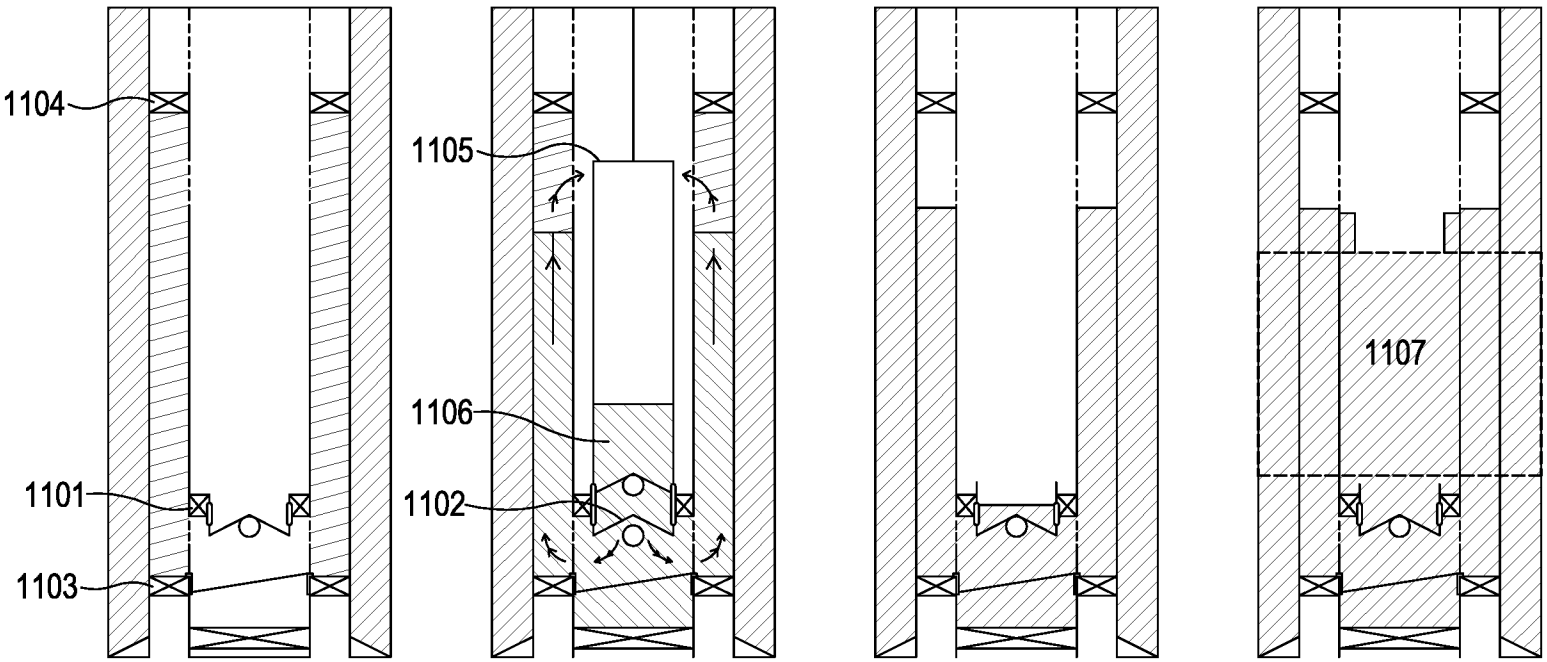
FIG. 11A illustrates a lap plugging with landing packer procedure.

FIG. 11A shows a lap plugging procedure with a landing packer. The landing packer comprises 1101 a check valve 1102. A fundament to spot the cement is provided both in the production tubing/liner and in the annulus 1103. A circulation path is established by perforating the production tubing longitudinally above the fundament of the annulus 1103 to generate a first set of perforations. If there is no return path back to surface through the A-annulus, a second set of perforations is created above the lowermost perforations. In an example, the perforation is made immediately above the fundament of the annulus, and the second set of perforations are generated below a production packer 1104 disposed longitudinally above the fundament of the annulus 1103. When releasing the cement through the first set of perforations (lowermost) in the production tubing, the check valve 1102 integrated on the landing packer 1101 is set as close as possible to the lowermost perforations.

The landing packer 1101 is configured to receive the device 1105 after it is run into the wellbore. After releasing the sealant, the check valve 1102 integrated on the landing packer 1101 is configured to prevent cement 1106 from u-tubing back into the production tubing. In an example, displacement fluid replaces the cement as it is released from the device. The cement 1106 is then left to set, and the mechanical integrity of the A-annulus can be verified. Optionally, the method may comprise a B-annulus too. In a final step, cement 1106 is spotted on the top of the landing packer 1101 inside the production tubing to create the required longitudinal cross section barrier. Therein forming the plug 1107. In some examples, the sealant is cement.

Figure 11B:
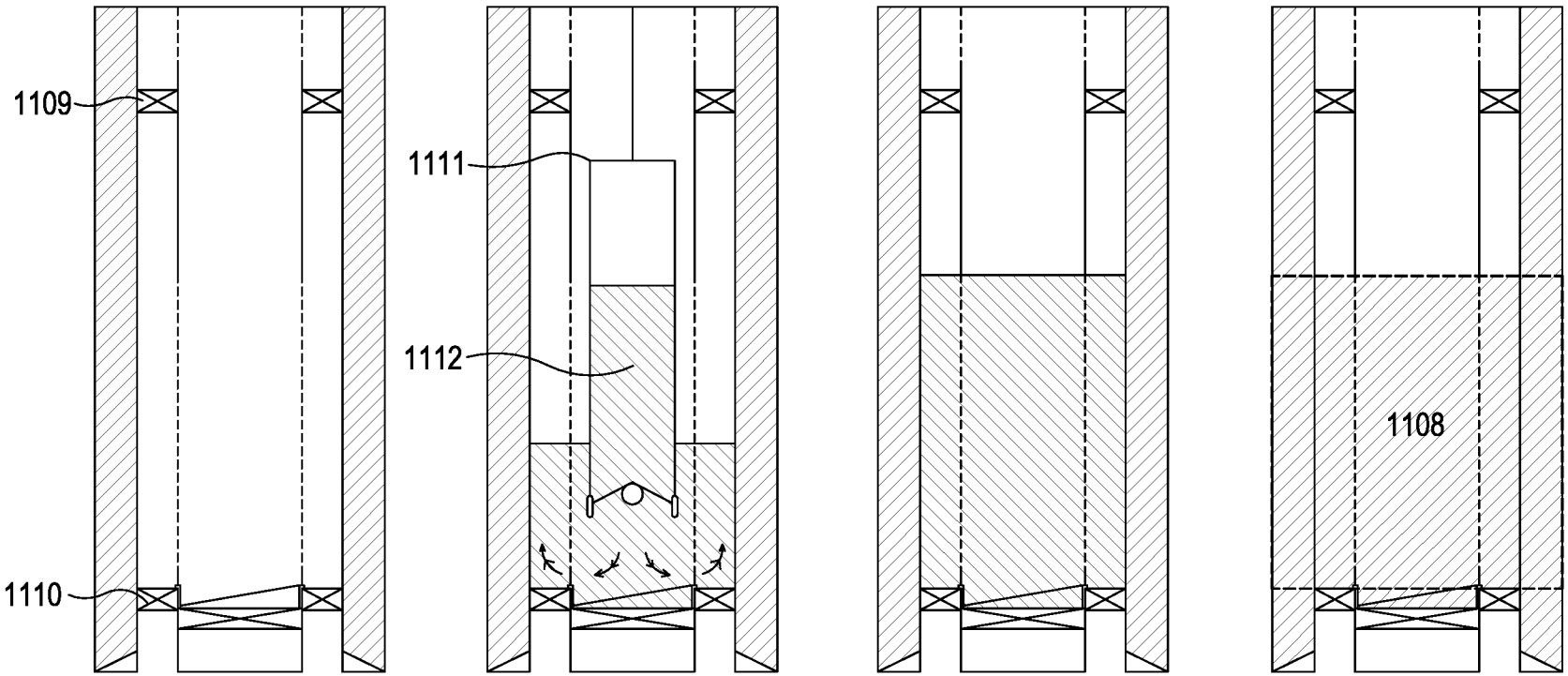
FIG. 11B illustrates a lap plugging without landing packer procedure.

FIG. 11B shows a lap plugging procedure without a landing packer. In this example, a plug 1108 is provided by spotting cement in the production tubing and the A-annulus defined between the production tubing and the production casing at well depths below the production packer 1109. A fundament 1110 for cement is provided both in the production tubing and in the A-annulus. In this method, the A-annulus and the production tubing are filled simultaneously. In this example, perforations are provided into the production tubing along the entire longitudinal length of the envisaged plug. This increases the maximum flow area for cement to enter into the A-annulus. These perforations may comprise an array of openings in the production tubing.

The device 1111 is then run into the well, and positioned longitudinally above the fundament in the production tubing. In the release step, a controlled process of emptying the sealant from the device 1111 is required. In an example, sealant is cement. The cement 1112 is released while the device 1111 is retracted from the wellbore. The rate of retraction matching the filling rate of the production tubing and A-annulus. During this release process, displacement fluid may replace the cement 1112 in the device 1111. The cement is then left to set and the barrier plug 1108 is established.

Figure 12A:
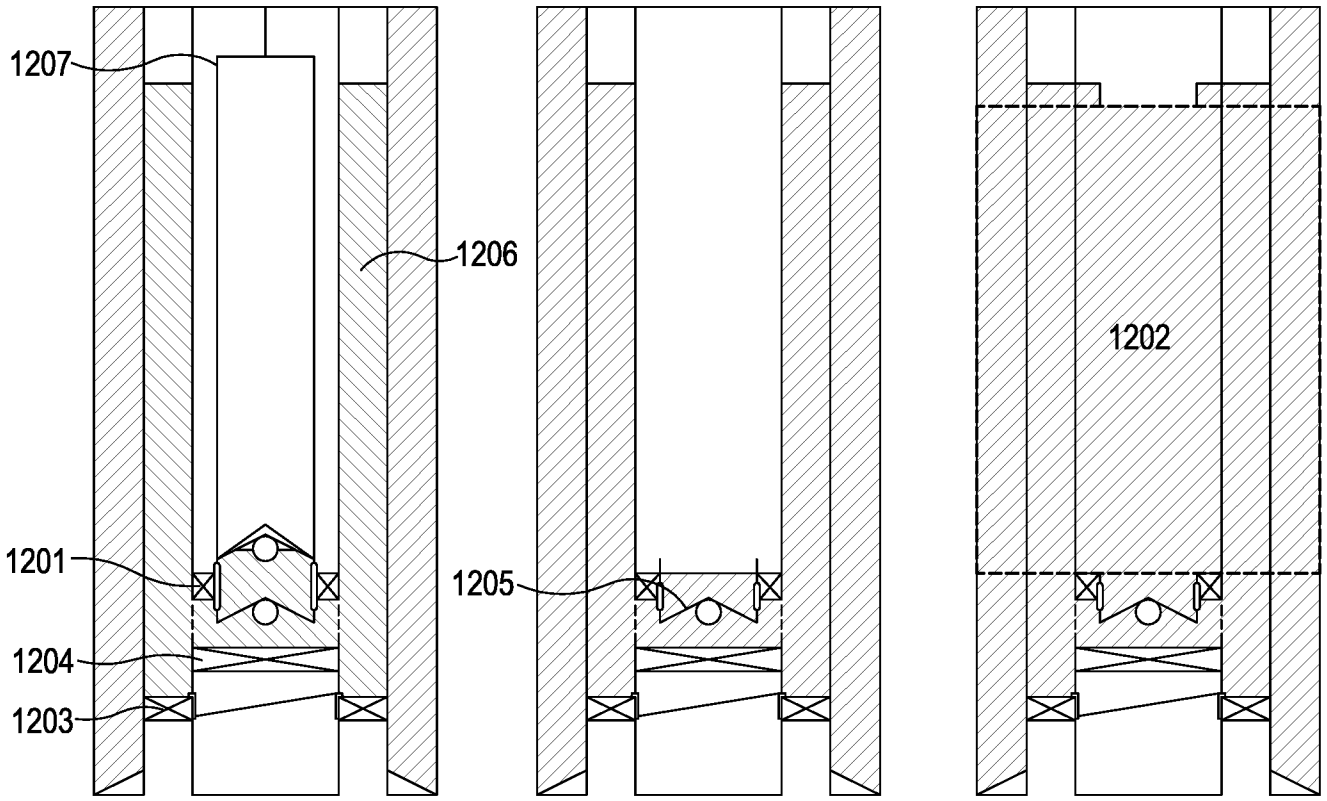
FIG. 12A illustrates an A-annulus cementing above production packer with landing packer procedure.

FIG. 12A shows a procedure to provide an A-annulus cementing without control lines and with a landing packer 1201. In this example, a plug 1202 is provided by spotting cement in the production tubing and the A-annulus defined between the production tubing and production casing at well depths above the production packer 1203. This allows for return circulation back to the surface. A fundament 1204 for cement is provided in the production tubing. In some examples, the production packer 1204 may function as the fundament 1203 for the A-annulus portion. However, if a production packer 1204 is not present, then an alternative fundament 1203 is provided into the A-annulus.

A circulation path is established by perforating the production tubing longitudinally above the fundament 1203 of the annulus. In an example, the perforations are made immediately above the fundament 1203 of the annulus. When releasing the cement through the perforations in the production tubing, the check valve 1205 integrated on the landing packer 1201 is set as close as possible to the lowermost perforations.

The landing packer 1201 is configured to receive the device after it is run into the wellbore. After releasing the cement 1206, the check valve 1205 integrated on the landing packer 1201 is configured to prevent cement 1206 from u-tubing back into the production tubing. After the cement 1206 is spotted, device 1207 is released from the landing packer 1201, and retracted from the wellbore. The cement 1206 is then left to set, and the mechanical integrity of the A-annulus can be verified. Optionally, the method may comprise a B-annulus too. In a final step, cement 1206 is spotted on the top of the landing packer 1201 inside the production tubing to create the required longitudinal cross section barrier. Therein forming the plug 1202. In some examples, the sealant is cement.

Figure 12B:
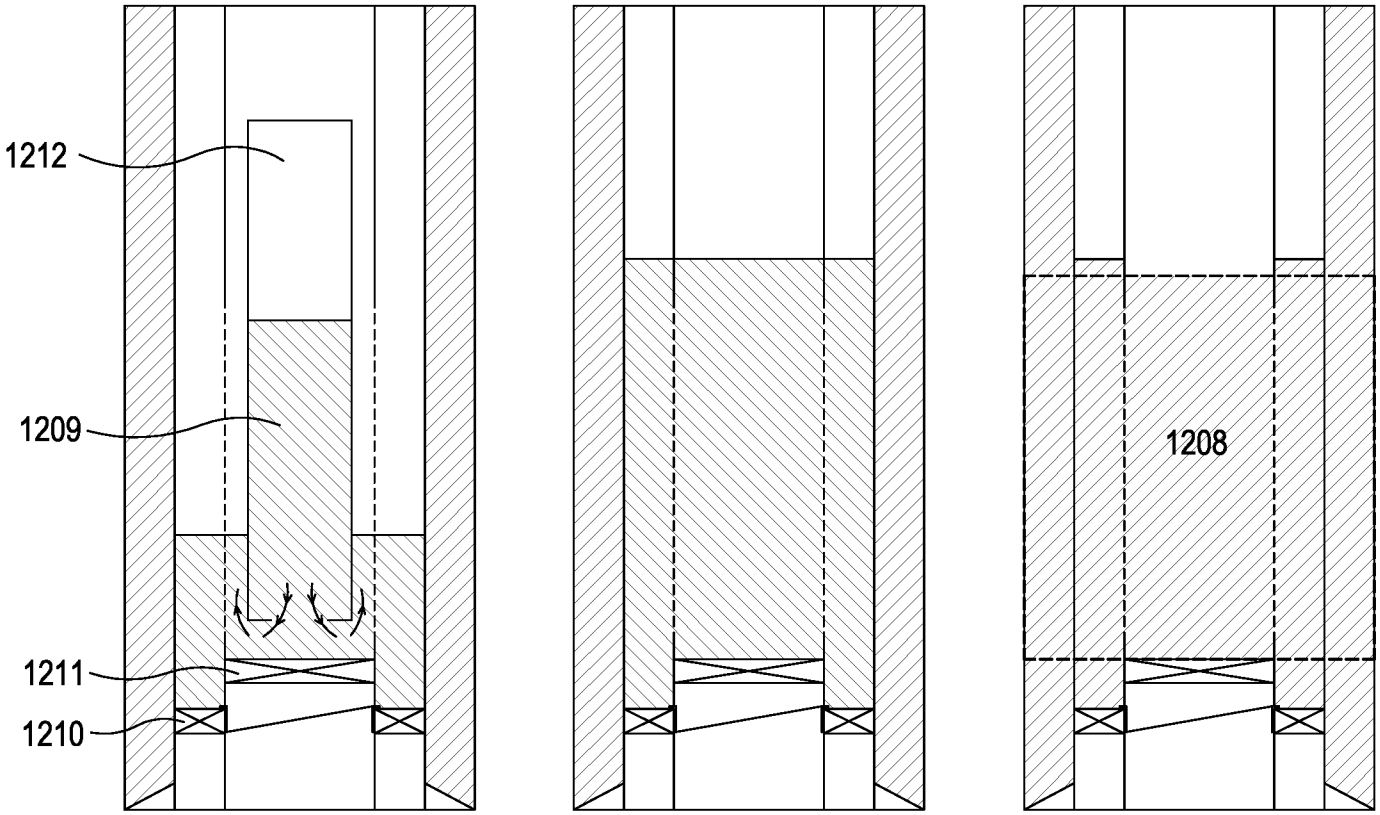
FIG. 12B illustrates an A-annulus cementing above production packer without landing packer procedure.

FIG. 12B shows a procedure to provide an A-annulus cementing without control lines and without a landing packer. In this example, a plug 1208 is provided by spotting cement 1209 in the production tubing and the A-annulus defined between the production tubing and production casing at well depths above the production packer 1210. A fundament 1211 for cement is provided in the production tubing. In some examples, the production packer 1210 may function as the fundament 1211 for the A-annulus portion. However, if a production packer 1210 is not present, then an alternative fundament 1211 is provided into the A-annulus.

In this example, cement 1209 is provided into the production tubing and the A-annulus simultaneously. In this example, perforations are provided into the production tubing along the entire longitudinal length of the envisaged plug. This increases the maximum flow area for cement to enter into the A-annulus. These perforations may comprise an array of openings in the production tubing.

The device 1212 is then run into the well, and positioned longitudinally above the fundament 1211 in the production tubing. In the release step, a controlled process of emptying the cement from the device 1212 is required. In an example, the cement 1209 is released while the device 1212 is retracted from the wellbore. The rate of retraction matching the filling rate of the production tubing and A-annulus. In an example, displacement fluid replaces cement in the device 1211. The cement 1209 is then left to set and the barrier plug 1208 is established.

Figure 13A:
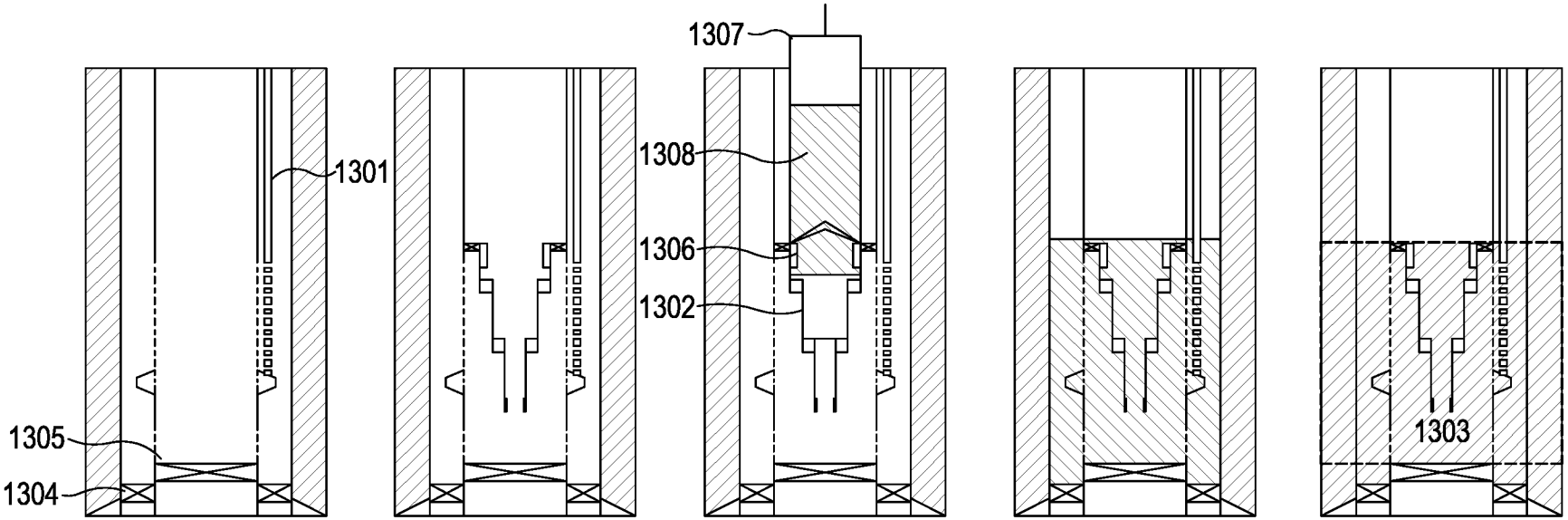
FIG. 13A illustrates an A-annulus cementing above production packer with cut control cables and a stinger.

FIG. 13A shows a procedure for providing an A-annulus cementing with control lines 1301 and with a stinger 1302. In this example, a cement plug 1303 is provided by spotting cement in the production tubing and the A-annulus defined between the production tubing and the production casing at well depths above the production packer 1304. Control cables 1301 are present in the A-annulus. A fundament 1305 for cement is provided in the production tubing. Typically, a production packer 1304 may be used as a fundament 1305 in the A-annulus, but, if a production packer 1304 is not present, then a fundament 1305 may be provided in this region.

In this example, there are control cables 1301 disposed outside the production tubing in the A-annulus region. During the step of perforating the production tubing, the control cables 1301 are also severed.

The stinger assembly 1302 is then run into the wellbore, and a packer on top of the stinger assembly 1306 is set longitudinally above the uppermost perforation in the production tubing. The longitudinal length of the stinger assembly should be such that the bottom of the stinger is as close as possible to the cement fundament 1305 in the production tubing. In some examples, telescopic stingers may be adopted.

After the stinger 1302 is set in place. The device 1307 is run into the wellbore, and the cement/sealant 1308 is released down through the stinger 1302 and enters the A-annulus through the perforations in the production tubing. Displacement fluid may replace the cement as it is released from the device 1307. When all the cement 1308 is spotted, the device 1307 is released from the stinger packer 1306, and retracted from the wellbore. The cement 1308 is left to set and the plug 1303 is generated.

Figure 13B:
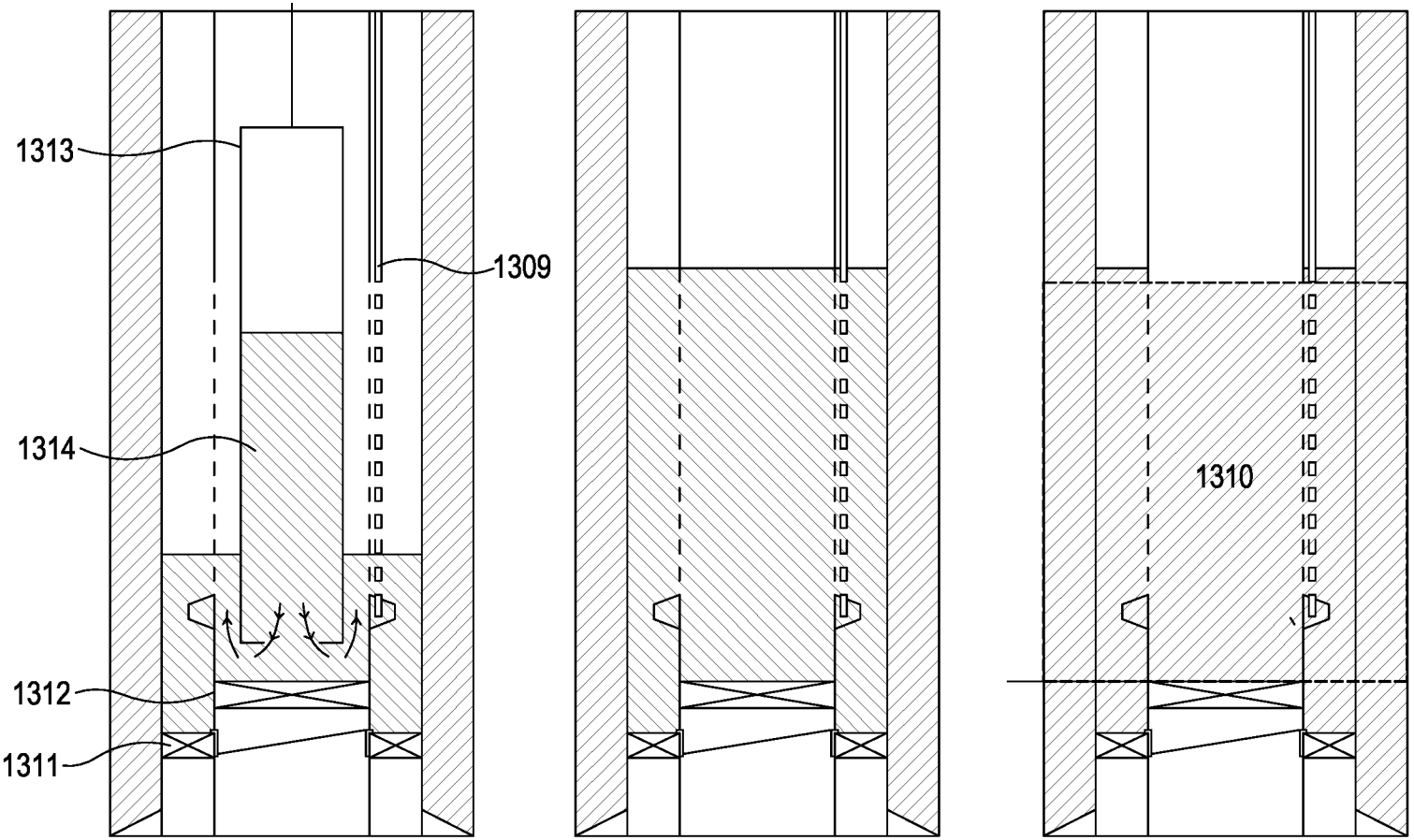
FIG. 13B illustrates an A-annulus cementing above production packer with cut control cables and without a stinger.

FIG. 13B shows a procedure for providing an A-annulus cementing with control lines 1309 and without a stinger. In this example, a cement plug 1310 is provided by spotting cement in the production tubing and the A-annulus defined between the production tubing and the production casing at well depths above the production packer 1311. Control cables 1309 are present in the A-annulus. A fundament 1312 for cement is provided in the production tubing. Typically, a production packer 1311 may be used as a fundament 1312 in the A-annulus, but, if a production packer 1311 is not present, then a fundament 1312 may be provided in this region.

In this example, there are control cables 1309 disposed outside the production tubing in the A-annulus region. During the step of perforating the production tubing, the control cables 1309 are also severed.

The device 1313 is then run into the wellbore, and positioned longitudinally above the fundament 1312 in the production tubing. The cement 1314 is then released. In the release step, a controlled process of emptying the cement 1314 from the device 1313 is required. In an example, the cement 1314 is released while the device 1313 is retracted from the wellbore. In an example, displacement fluid replaces the cement 1314 during release. The rate of retraction matching the filling rate of the production tubing and A-annulus. The cement 1314 is spotted both in the production tubing and the surrounding A-annulus. The cement 1314 is then left to set and the barrier plug 1310 is established.

Figure 14:
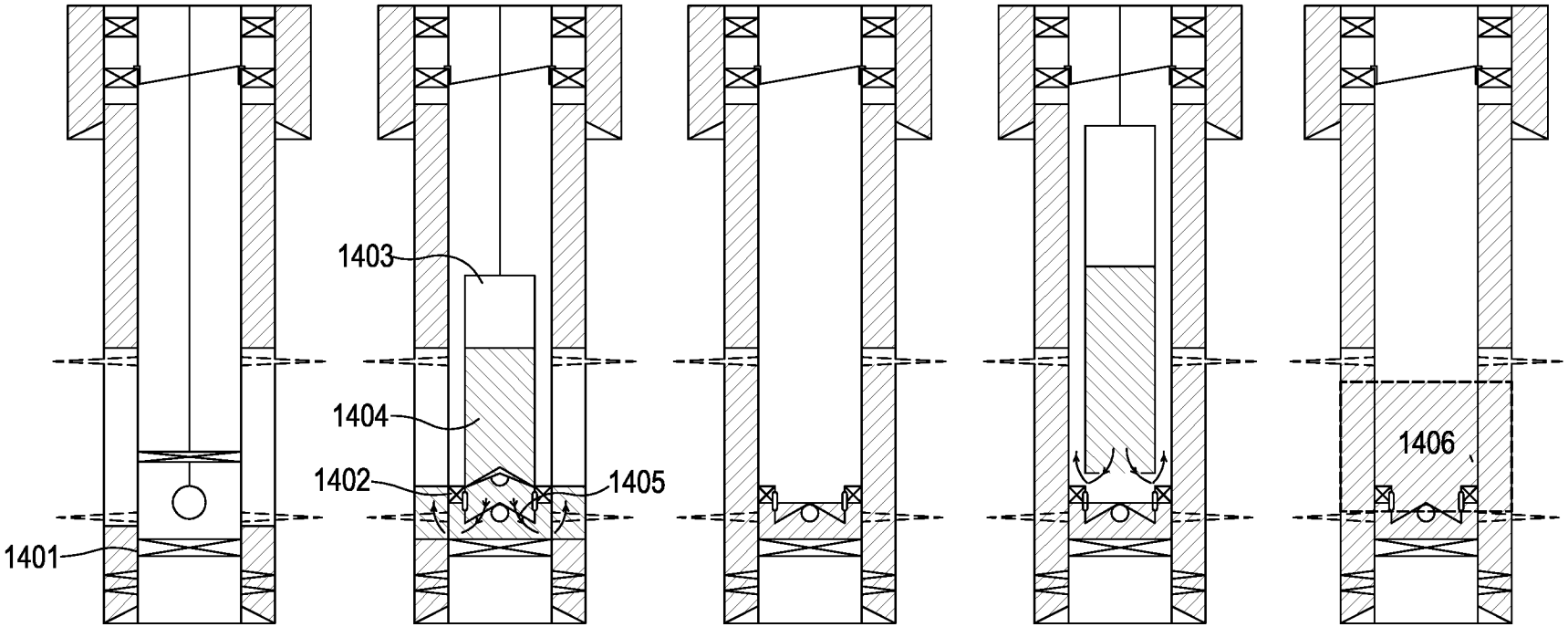
FIG. 14 illustrates a squeeze plugging procedure.

FIG. 14 shows a squeeze plugging procedure. The procedure is similar to that described in FIG. 11A. However, in this example, the method is used for squeezing cement into a poorly cemented annuli. In general, the poor cemented annuli may be determined beforehand from cement bond logging. A fundament 1401 for cement and for leak testing (typically a mechanical bridge plug) is placed at the bottom of the region of interest. Then, a perforation assembly is run into the surrounding annulus and further into the formation. The perforation assembly is configured to provide perforations/openings through the tubular. For example, the perforations are established in 50-100 m intervals, in the predetermined locations where poor/no cement is present in the annulus. A mechanical plug is placed between the lowermost and uppermost perforation, and a pressure gauge is provided longitudinally below the mechanical plug. A leak test is then carried out between the lowermost and uppermost perforations. This leak test confirms that a leak is present, and that a leak path exists. The pressure gauge is used to monitor the pressure in the enclosed volume between the mechanical plug and the fundament, and therefore is used to detect the leak.

After a leak is determined, the mechanical plug and the gauge are retracted from the wellbore to the surface. A landing packer 1402 is then provided into the wellbore as close to the lowermost perforation as possible. The device 1403 is then run and latched/stung into the landing packer 1402. When emptying the cement 1404 from the device 1403, the cement 1404 is introduced into the annulus and into the leak path. The cement 1404 therefore fills the leak path. When all the cement 1404 or the leak paths are completely filled, then the device 1403 is released from the landing packer 1402. In an example, displacement fluid replaces the cement as it is released. The landing packer 1402 is integrated with a check valve 1405 which prevents u-tubing of the released cement 1404 back into the tubular. The cement 1404 is then left to set. The mechanical integrity of the cement 1404 in the A-annulus can be verified either by cement bond logging, or from similar leak testing between established perforations, as described above. When the mechanical integrity confirmed, the device tool 1403 is run back into the wellbore to spot cement on top of the landing packer to create the required longitudinal length of plug. Therein forming the plug 1406.

The similar procedure may be adopted for squeezing cement into a poorly cemented B-annulus. However, this step is carried out after cementing up the A-annulus.

Figure 15:
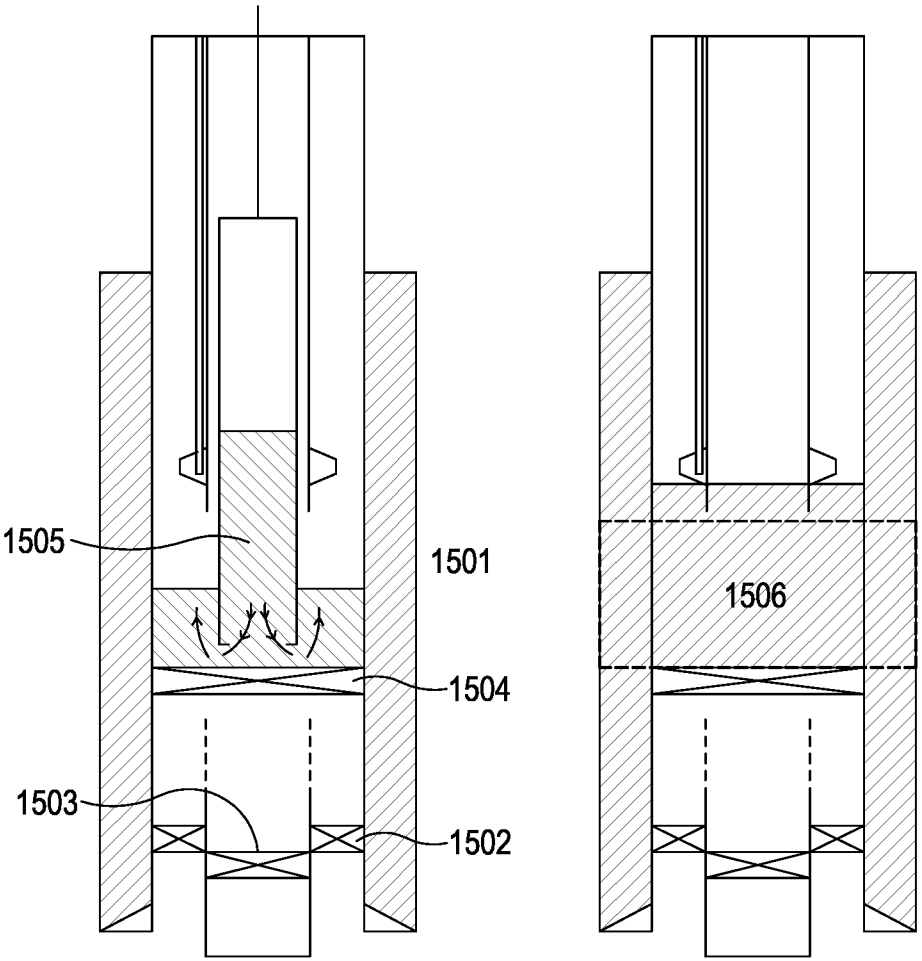
FIG. 15 illustrates a tubing window plugging procedure.

FIG. 15 shows a tubing window plugging procedure. In this example, a tubing gap 1501 is provided in the wellbore by pulling out a section of the tubing. Preferably, the section of tubing may longitudinally above the production packer 1502, and up to 150-200 metres in length. The production packer 1502 therefore acts as a fundament 1503 for cement. However, if a production packer 1502 is not present, then a fundament 1503 may be provided in the annulus. In some examples, a mechanical plug 1504 is provided as a fundament for the cement. The device is then run into the wellbore, and cement 1505 is released into the window region on top of the fundament/mechanical plug 1504. The cement 1505 is then left to set, and the required longitudinal length of barrier is established. Therein forming the barrier 1506.

The method for verifying the cement plug mechanical integrity depends on the plugging method and the respective conditions. By way of overview, verification methods may comprises one or more of the following: i) wireline based dressing and tagging of cement; ii) leak testing; iii) inflow testing; iv) conventional cement bond logging; v) noise logging; and vi) alternative annular barrier verification (leak-testing cement between perforations).

In some examples, the container device may comprise a hose. The hose may be a flexible material that is coiled during storage. The hose is used in addition to, or instead of the tubular sections which form a rigid housing and which are assembled at the surface. The flexible material may comprise a composite material. In an example, the hose may be a reinforced plastic. During assembly, a predetermined length of the hose may be provided into the wellbore. The predetermined length is calculated to provide a sufficient volume of sealant in order to completely fill the envisaged plug. The lower plug of the container device may be inserted from the top and pushed down by filling the chamber with the plugging material/sealant. The upper plug of the container device may then be added after filling the hose with the plugging material. The hose may also comprise all the features of the container device as previously described. For example, the hose may comprise the pressure control device at the top of the device, and the opening mechanism at the bottom of the hose. This assembly method is particularly advantageous as the deployment is rapid. In some examples, the bottom portion of the hose may comprise an electrically controlled release mechanism. In other examples, the spike or a burst mechanism as previously described may be adopted. Preferably, the container device is deployed on a wireline.

In some examples, the hose is provided within a larger tubular. This tubular may comprise a flexible material. The annulus defined between the hose and the tubular is used to provide electrical connections to components in the lower portion of the container device to which the wireline is not directly connected. For example, driver components in the electrically controlled release mechanism at the bottom of the hose may be activated using these electrical connections. These electrical connections may be provided before deployment into the wellbore. For example, the electrical connections may be made onshore. In some examples, a wireline tractor may also be provided at the bottom of the hose. The wireline tractor may also be used to deploy the release mechanism. A wireline tractor helps to pull the hose into the wellbore. A wireline tractor is known as such to the skilled person and does therefore not need to be described in detail herein.

The device and method as previously described may further comprise an apparatus configured to improve the mechanical quality of the set cement. The apparatus may for example comprise a vibration assembly. The vibration assembly may be used to: i) remove air pores in the plugging material when in the device; and ii) reduce the size of pores in the plugging material after setting. Herein, device is referred to as container device to emphasise that the device contains sealant fluid.

In some examples, the sealant preferably comprises a cement-water mixture. The exact proportion of each may be determined based on the required workability of the cement mixture. The required workability may be determined based on the width of the annular region. For example, tighter clearances may require a greater proportion of water to ensure sufficient workability and fluidity. In some examples, aggregates may be added to the cement-water mixture, such that when the mixture sets, the plugging material is a form of concrete. During the initial mixing stage, gypsum may be added to the mixture (sealant fluid) to retard hydration of the cement and prevent premature curing in the bailer before release. The mixing process to form the cement-water unavoidably introduces entrapped air into the mixture. It is important to remove these air pores before the cement mixture sets as they compromise the mechanical integrity of the plug.

During the setting process, cement reacts with the water in the mixture via a hydration process. The process forms hydrates, such as calcium silicate hydrate (CSH), and the like. These hydrates provide the strength of the cement. In an example, the formation of CSH is associated with a dissolution-precipitation reaction. The CSH preferentially precipitates on the prior cement particles, generating a coating around the cement particle. For the prior cement particle to react further with water, the water must diffuse through the CSH coating to reach the cement particle beneath. This diffusive process retards the kinetics of the hydration reaction with time, and the curing process in cement is slow.

The chemical precipitation of CSH is also attributed with a large volume reduction. As such, the cement mixture shrinks during the curing process. This shrinkage leads to consolidation of cement particles within the mixture. Initially, when the cement is sufficiently wet, water in the mixture is interconnected and the water may flow to prevent the build-up of internal stresses. However, as the fraction of water is depleted during the reaction, and the CSH fraction grows, water becomes restricted to isolated pores, and water flow cannot accommodate any shrinkage. This may cause internal stresses to develop within the mixture.

It is common to provide excess water into the cement-water mixture to ensure that the cement hydration reaction reaches completion. In these circumstances, excess water is left after the reaction reaches completion. The excess water forms pores that effectively act as cracks within the cement. The water may also evaporate over time to leave behind air pores. The size and number of these pores depends on the gelling strength of the cement-water mixture. During the setting process, agglomeration may occur that causes larger pores to grow and develop.

As such, there are two different sources of pores that reduce the mechanical strength of a cement plug. The first is entrapped air, introduced during pouring the cement-water mixture into the device and the second is pores that form (and grow) during the hydration reaction. The aim in the latter is to homogenise the pores that inevitably result after the hydration reaction reaches completion.

During the release of the cement-water mixture from the device, it is appreciated that air ingress into the cement worsens the mechanical performance of the set cement. As such, the release of the cement should be sufficiently controlled in that the flow is laminar and not turbulent. The methods as previously described are especially suited in this respect as the sealant is forced upwards against gravity, which decreases the propensity of turbulent flow.

In some examples, the container device may comprise a vibration assembly. The vibration assembly is configured to remove entrapped air within the cement-water mixture. In an example, the container device may not contain any significant air gap at the top portion. As such, vibration of the container device and the cement-mixture may not develop longitudinal flow within the mixture (as to a first approximation the mixture is incompressible). In some examples, the vibration assembly may comprise one or more vibration elements. The vibration elements are mechanically coupled to the container device, and thus are able to deliver energy/vibration to the cement-water mixture. In an example, the vibration elements comprise an annulus that is disposed around the container device. The vibration elements are configured to oscillate in the radial direction. This vibration increases diffusion within the mixture and causes air bubbles to rise faster. Preferably, the energy of the vibration is not large enough to generate flocculation (agglomeration) of the cement particles in water. These flocs generally encourage larger pores to develop during hydration, and therefore significantly reduce strength. In effect, they increase the size of the largest defect within set cement, and the largest flaw in cements ultimately determine the overall strength.

Is also known that cement-water mixtures typically exhibit shear thinning behaviour. That is to say that under shear stress/strain, the cement-water mixture becomes less viscous. As such, the air bubbles may rise more quickly through the cement if flow is induced. In some examples, flow may be induced by rotating the container device on the wireline about the longitudinal axis. The inertia of the cement within the container device generates a circumferential flow within the mixture, and contributes to shear thinning. In this way, entrapped air is removed more rapidly from the cement-water mixture. This is especially important, as the container devices are large in dimension along the longitudinal direction. For example, container device lengths up to several tens of metres are expected. This geometry poses a particular problem in that entrapped air must travel a large distance for removal. The dormant period of a cement-water mixture (the period in which the mixture will not set) may not be long enough for this process to occur.

In other examples, the cement-water mixture may be added to the container device with a small air gap disposed at the top. In these examples, the vibration assembly may comprise displacement of the container device in the longitudinal direction. In an example, the container device may be disposed on a landing platform or packer. The landing platform or packer may be provided with controls to generate a vibrating displacement in the longitudinal direction. For example, electrical connections may be provided along the wireline and through the container device. If the container device is a hose, then the hose may be provided within a larger tubular, and the electrical connections may be disposed in the annulus defined between the hose and the tubular. The vibration elements may also be disposed within this annulus. Preferably, the amplitude of this displacement is smaller than the magnitude of the air gap at the top of the container device. In this process, the container device is oscillated in the longitudinal sense. During this oscillation, the inertia of the cement-water mixture leads to an oscillating flow in the longitudinal sense relative to the container device. The mixture oscillates out of phase with the container. As mentioned, it is preferable that this relative displacement between the cement mixture and the container device is smaller than the air gap so that air is not reintroduced into the mixture in a turbulent process. The frequency of this vibration is sufficiently low that the cement-water mixture is able to move within the container.

In some examples, a combination of any of the vibration methods may be adopted. The duration of the vibration or pulse, the power and the frequency (rotational or longitudinal) of the vibration may be varied for specific conditions. For example, these parameters may vary depending on the specific chemistry of the cement-water mixture, the quantity of entrapped air, length of container along the longitudinal direction and the estimated time of the dormant period of the mixture.

After releasing the cement-water mixture from the container, the mixture fills the annulus region in the wellbore to form the plug. In this filling process, air pores may develop from incomplete filling. However, the method of generating the plug as previously disclosed is especially well suited to avoid incomplete filling. For example, in this arrangement, the cement-water mixture is pumped longitudinally up the wellbore against the weight of the mixture. Therefore, as opposed to conventional plug formation processes, the weight of the mixture does not provide the driving force for complete filling. Instead, the pressure control device can ensure that sufficient pressure is applied to such that complete filling occurs. This pressure can be larger than the weight of the cement mixture. This arrangement is therefore especially advantageous in eliminating incomplete filling air pores. However, there is still a problem associated with the edges of the annular region, which may be rough and irregular, and particularly prone to incomplete filling.

In some examples, a second vibration assembly may be used to encourage complete filling of the plug. The second vibration assembly may be disposed internally around the circumferential edge of the tubular/production tubing within the wellbore. In an example, the second vibration assembly comprises one or more vibration elements. The vibration element is configured to encourage radial displacement of the tubular/production tubing and remove pores within the annulus. The production tubing region radially adjacent to the envisaged plug may be mechanically constrained within the wellbore. For example, the tubular/production tubing may be mechanically coupled to other heavy components within the wellbore (production packers and the like). These components restrict and dampen vibration of the tubular/production tubing, and large energies are therefore required to vibrate the production tubing region. High power vibration elements are expensive, and can be dangerous—they cannot be easily deployed into the wellbore. This method also provides a further step carried out prior to the release of the cement-water mixture from the container device to reduce the power requirements of vibration and to at least partially solve this problem.

In some examples, the region of production tubing radially adjacent to the envisaged plug may be reduced in effective weight. By effective weight, it is meant that the vibration of this region is dampened by an effective weight. This effective weight therefore includes all regions which are mechanically coupled/restrain said region. In one example, the perforations in the production tubing/tubular are modified. This modification may comprise increasing the size and number of perforations, such that the production tubing/tubular may move more freely relative to surrounding/restraining portions. In other examples, a circumferential perforation may be made into the production tubing/tubular to completely decouple the production tubing region from any regions longitudinally opposite said circumferential perforation. This perforation may completely replace the previous step of punching holes/generating perforations into the production tubing. In this example, the production tubing/tubular may more freely move under vibration. Perforating the production tubing/tubular is therefore a particularly efficient way to reduce the power requirements of the vibration elements in the second vibration assembly. It is particularly preferable to locate the vibration elements as close to the circumferential perforation as possible to encourage the largest displacement of the production tubing. These perforations may also act as the entry point for cement from the hose/container device into the annulus.

The second vibration assembly may also reduce the development of the pores during the curing process of the cement. For example, during the setting process, the gel strength of the mixture may increase. This increase may be attributed to the transition of dominant interaction force regimes. Initially, the cement particles are far away (>100 nm) from one another, and the dominant force is the repulsive Coulomb force between the charged cement particles. During consolidation, the particles are brought closer to one another, and eventually they are close enough for the attractive Van der Waals force to win out. This gelling process develops pores, as the cement particles are not able to fill the provided space. In some examples, depending on the rate of gelling, the gelling may lead to agglomeration of the cement particles forming larger isolated clusters. In this scenario, the average pore size increases. Vibration during this stage provides a driving force to prevent this agglomeration, and ensures that the pores (due to excess water and possible agglomeration of cement particles) are homogenised as much as possible. This effectively reduces the average size of the pores. As previously mentioned, the mechanical strength of cements is determined by their largest flaw (Weibull statistics), and therefore homogenising the pores, increases the statistical strength of the plug.

In some examples, the production tubing/tubular may not be centred along the central longitudinal axis of the wellbore. That is to say, the longitudinal axis of the production tubing/tubular and longitudinal axis of the wellbore are not collinear. In these examples, the clearance in the annulus portion of the seal may be very tight in particular sections of the annulus. A radial oscillation of the production tubing/tubular varies the size of this clearance and prevents the cement-mixture from clogging in these tight clearance sections. This radial oscillation may be generated by the second vibration assembly. If the section of production tubing/tubular radially adjacent to the plug is mechanically decoupled by severing the production tubing/tubular completely, then vibration may also help to realign the production tubing/tubular with the wellbore. In another example, the misalignment may be determined before the method of plugging, and perforations in the tubular are designed to increase flow locally into the sections of the annulus proximal to the tighter clearance sections. In this way, the flow of the sealant may force the tubular to realign with the wellbore via interaction with the formation.

At the latter stages of the curing process, the cement behaves effectively as a solid, it is preferable to cease vibration. In these stages, vibration may cause damage by introducing flaws into the set cement. Therefore, vibration is preferable in the early stages of setting (while the fluid can still accommodate the build-up of internal stress). The period to carry out this vibration will vary depending on the chemistry of the cement-water mixture (composition, constituents etc.), the estimated set time and the temperature. During this second vibration, and for the reasons already mentioned, the power, frequency of said vibration may vary as a function of time. For example, it is preferable that the vibration frequency is slow enough to enable movement in the cement mixture. Over time, the cement gels are the mixture will become more viscous. The frequency would then be appropriately reduced. Likewise, as the gel strength of the cement mixture increases the power may be correspondingly increased to ensure movement.

The second vibration assembly may comprise one or more vibration elements. These vibration elements may comprise an annulus in contact with the inner edge of the tubular/production tubing. The vibration elements are configured to oscillate in the radial direction. In an example, the first vibration assembly may be the same as the second vibration assembly and the annuli vibration elements around the container device may also be contact with the inner edge of the tubular/production device. In another example, the vibration elements may be disposed on regions of the production tubing/tubular radially adjacent to sections of the annulus with tight clearance. In these examples, it is preferable that the one or more vibration elements are oscillating in phase with one another.

In some examples, the vibration assembly may be dynamic and capable of motion relative to the container device and/or wellbore. For example, the vibration elements may be deployed on an extendable member. The extendable member may be a telescopic robotic arm. In other examples, the extendable member may be a conventional robotic arm. The robotic arm may be capable of motion in the radial and longitudinal direction of the production tubing/tubulars via a hinging mechanism controlled by one or more actuators. One or more of these robotic arms may be deployed along the length of the hose/container device.

Although the invention has been described in terms of preferred embodiments as set forth above, it should be understood that these embodiments are illustrative only and that the claims are not limited to those embodiments. Those skilled in the art will be able to make modifications and alternatives in view of the disclosure which are contemplated as falling within the scope of the appended claims. Each feature disclosed or illustrated in the present specification may be incorporated in the invention, whether alone or in any appropriate combination with any other feature disclosed or illustrated herein.

The invention claimed is:

1. A container device for transporting and releasing a plugging material into a well, the container device comprising:

a longitudinal chamber for containing the plugging material, the chamber comprising a tubular wall extending in a longitudinal direction and at least one opening for releasing the plugging material from the chamber;

a lower seal extending across the opening and closing the chamber in a closed configuration;

an upper seal, wherein the upper seal, the lower seal and part of the tubular wall of the longitudinal chamber are arranged to enclose the plugging material in use;

a pressure application mechanism provided at an upper portion of the container device for pressurising at least part of the device and expelling the plugging material; and a connector provided at the upper portion of the container device for attaching the container device to an elongate member for lowering into a wellbore, wherein the pressure application mechanism comprises said upper seal, and further comprises a connection to the lower seal, and wherein the lower seal is connected to a plug configured to be set against a casing or tubular outside the container device.

2. The container device according to claim 1, wherein the lower seal comprises a plug extending across an inner diameter of the tubular wall of the longitudinal chamber perpendicular to the longitudinal direction of the chamber, and wherein the lower seal has a mobile sealing connection such that the lower seal is configured to travel along an inner tubular wall while maintaining a sealing connection to the tubular wall.

3. The container device according to claim 2, further comprising a landing profile arranged to receive the lower seal.

4. The container device according to claim 3, wherein the lower seal when received in the landing profile, is arranged to open when a predetermined threshold pressure within the container above the lower seal is exceeded.

5. The container device according to claim 3, wherein the lower seal when received in the landing profile is arranged to be burst by interaction with a lancet provided on a plug set in the well.

6. The container device according to claim 1, wherein the upper seal comprises a plug extending across an inner diameter of the tubular wall of the longitudinal chamber perpendicular to the longitudinal direction of the chamber, and wherein the upper seal has a mobile sealing connection such that the upper seal is configured to travel along the tubular wall in the longitudinal direction while maintaining a sealing connection to the tubular wall.

7. The container device according to claim 1, wherein the pressure application mechanism comprises a pump provided above the upper seal and wherein the upper seal is arranged to move away from the pump when a pressure above the upper seal increases above a threshold value.

8. The container device according to claim 1, wherein said connection has a predetermined maximum extension such that the upper seal has a fixed distance to the plug and travels down the container device when the container device moves to a surface while the plug is set against the casing or tubular.

9. The container device according to claim 1, further comprising a pressure equaliser provided in an upper part of the chamber above the upper seal.

10. The container device according to claim 1, wherein the connection further comprises a cable providing an electrical, mechanical or hydraulic connection to the plug for activating the plug.

11. The container device according to claim 10, further comprising a pump and a hydraulic chamber provided in the plug for setting the plug.

12. The container device according to claim 1, further comprising a check valve provided below the lower seal for preventing inflow of fluids from outside the container device.

13. The container device according to claim 1, further comprising one or more flapper valves provided below the lower seal for preventing inflow of fluids from outside the container device.

14. The container device according to claim 1, further comprising a latch provided at a lower part of the container device for latching onto a landing structure.

15. The container device according to claim 1, further comprising packers or slips provided outside the chamber for connecting to an external tubular or casing.

16. An assembly comprising:

the container device according to claim 1; and a landing packer for receiving the container device.

* * * * *